US005734948A

United States Patent [19]

Nagayama et al.

[11] Patent Number: 5,734,948

[45] Date of Patent: Mar. 31, 1998

[54] IMAGE STABILIZER

[75] Inventors: Katsuhiro Nagayama, Yamabe-gun; Jitsuo Masuda, Yamatotakada; Toshiaki Ino, Yamatokoriyama; Toshihisa Ishida, Kashiba; Katsuaki Sumida, Kitakatsuragi-gun; Hideji Saiko, Yamatokoriyama, all of Japan

[73] Assignee: Sharp Kabushiki Kaisha, Osaka, Japan

[21] Appl. No.: 729,050

[22] Filed: Oct. 10, 1996

[30] Foreign Application Priority Data

Oct. 12, 1995 [JP] Japan ..... 7-264239

[51] Int. Cl.[6] ..... G03G 15/00; G03G 15/02; G03G 15/04

[52] U.S. Cl. ..... 399/46; 399/49; 399/50; 399/52

[58] Field of Search ..... 399/52, 51, 50, 399/49, 48, 47, 46, 72, 128; 355/75; 430/902; 358/519, 298

[56] References Cited

U.S. PATENT DOCUMENTS 5,107,302 4/1992 Bisaiji ..... 399/49
5,214,474 5/1993 Ishizuka ..... 399/52
5,223,896 6/1993 Shimizu et al. ..... 399/46
5,453,773 9/1995 Hattori et al. ..... 358/298 X
5,499,079 3/1996 Kinoshita et al. ..... 399/46

FOREIGN PATENT DOCUMENTS 61-29502(B2) 7/1986 Japan .
6-167852(A) 6/1994 Japan .

*Primary Examiner*—Arthur T. Grimley
*Assistant Examiner*—Sophia S. Chen
*Attorney, Agent, or Firm*—David G. Conlin; David D. Lowry

[57] ABSTRACT

In order to effectively perform image stabilization by control of retaining initial characteristics of a photosensitive body, if correlation between initial and aged values corresponding to bright and dark part signals of the photosensitive body is such that a variation between the initial and aged values of the dark part signal (dark Δ) is greater than a variation between the initial and aged values of the bright part signal (bright Δ), an image stabilizer, first, controls a charging characteristic of the aged values by changing a charging output to the photosensitive body so that the bright Δ and the dark Δ are equal to each other. Next, the image stabilizer makes the aged characteristics of the photosensitive body virtually identical to the initial characteristics by changing an exposure output so that the aged and initial values of the dark part signal become equal to each other.

29 Claims, 23 Drawing Sheets

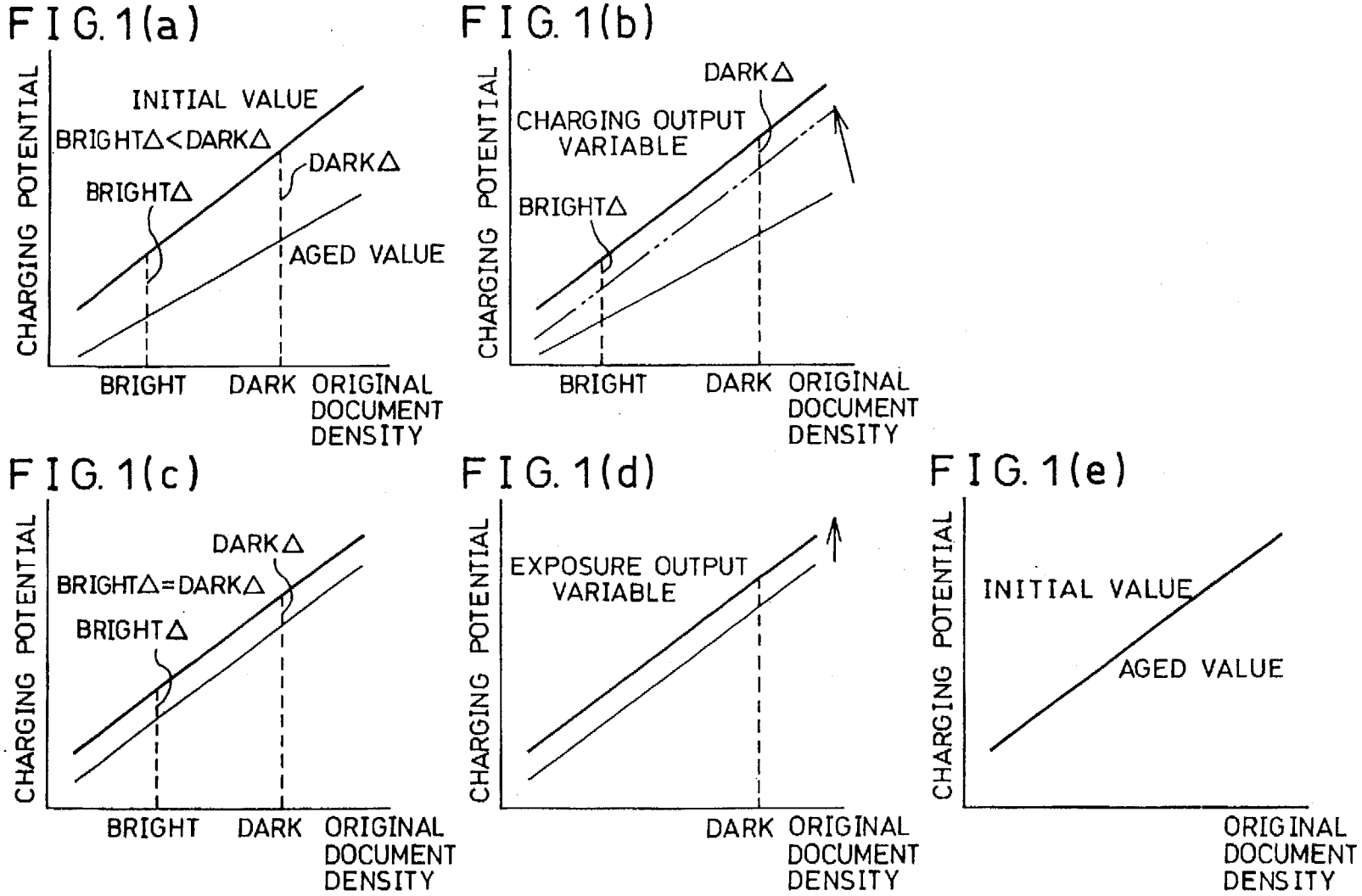
FIG. 1(a)
INITIAL VALUE
BRIGHTΔ<DARKΔ
DARKΔ
BRIGHTΔ
AGED VALUE
CHARGING POTENTIAL
BRIGHT
DARK
ORIGINAL DOCUMENT DENSITY
FIG. 1(b)
DARKΔ
CHARGING OUTPUT VARIABLE
BRIGHTΔ
CHARGING POTENTIAL
BRIGHT
DARK
ORIGINAL DOCUMENT DENSITY
FIG. 1(c)
DARKΔ
BRIGHTΔ=DARKΔ
BRIGHTΔ
CHARGING POTENTIAL
BRIGHT
DARK
ORIGINAL DOCUMENT DENSITY
FIG. 1(d)
EXPOSURE OUTPUT VARIABLE
CHARGING POTENTIAL
DARK
ORIGINAL DOCUMENT DENSITY
FIG. 1(e)
INITIAL VALUE
AGED VALUE
CHARGING POTENTIAL
ORIGINAL DOCUMENT DENSITY

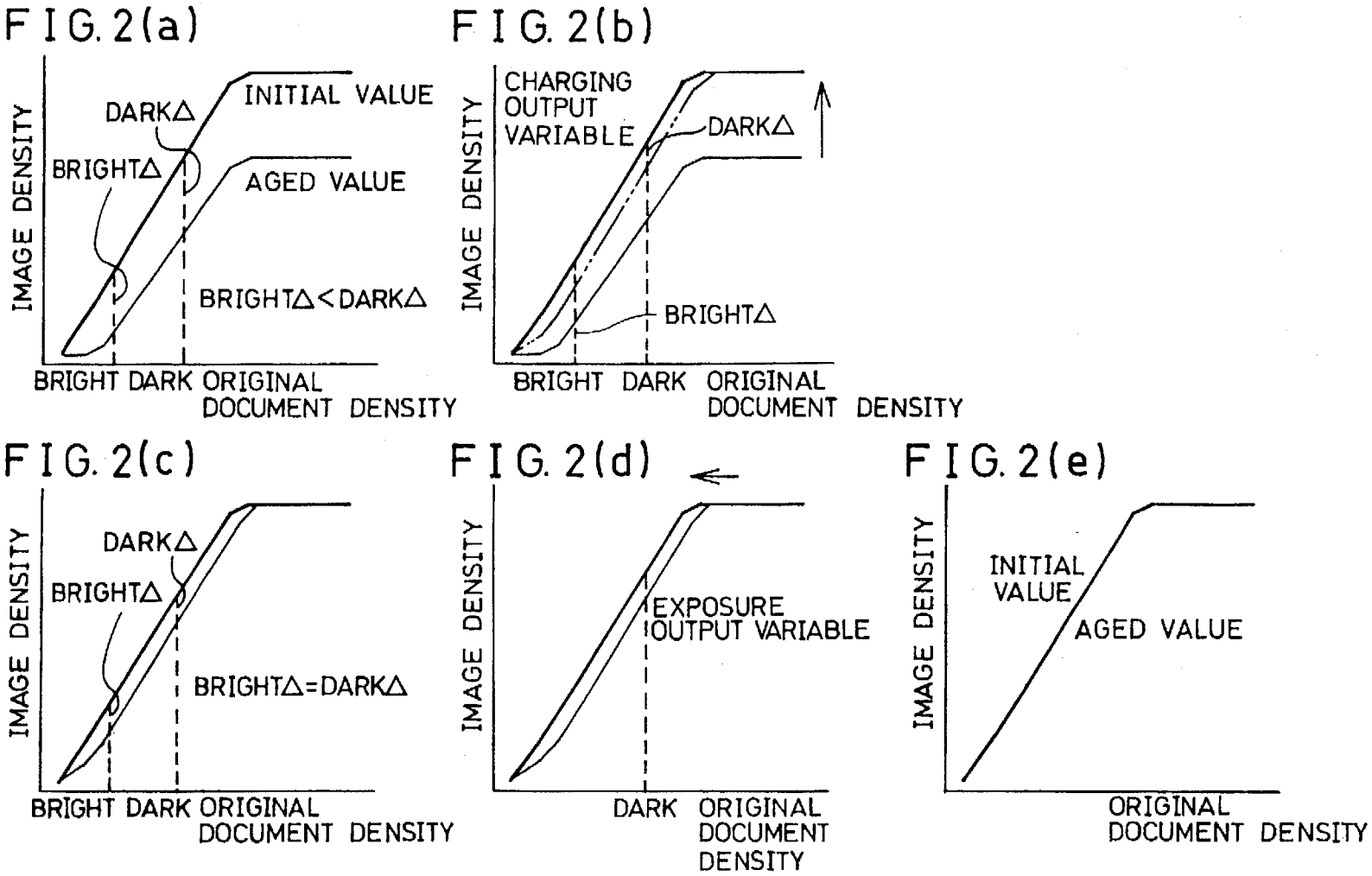
FIG. 2(a)
IMAGE DENSITY
INITIAL VALUE
AGED VALUE
DARKΔ
BRIGHTΔ
BRIGHTΔ<DARKΔ
BRIGHT DARK ORIGINAL DOCUMENT DENSITY
FIG. 2(b)
IMAGE DENSITY
CHARGING OUTPUT VARIABLE
DARKΔ
BRIGHTΔ
BRIGHT DARK ORIGINAL DOCUMENT DENSITY
FIG. 2(c)
IMAGE DENSITY
DARKΔ
BRIGHTΔ
BRIGHTΔ=DARKΔ
BRIGHT DARK ORIGINAL DOCUMENT DENSITY
FIG. 2(d)
IMAGE DENSITY
EXPOSURE OUTPUT VARIABLE
DARK ORIGINAL DOCUMENT DENSITY
FIG. 2(e)
IMAGE DENSITY
INITIAL VALUE
AGED VALUE
ORIGINAL DOCUMENT DENSITY

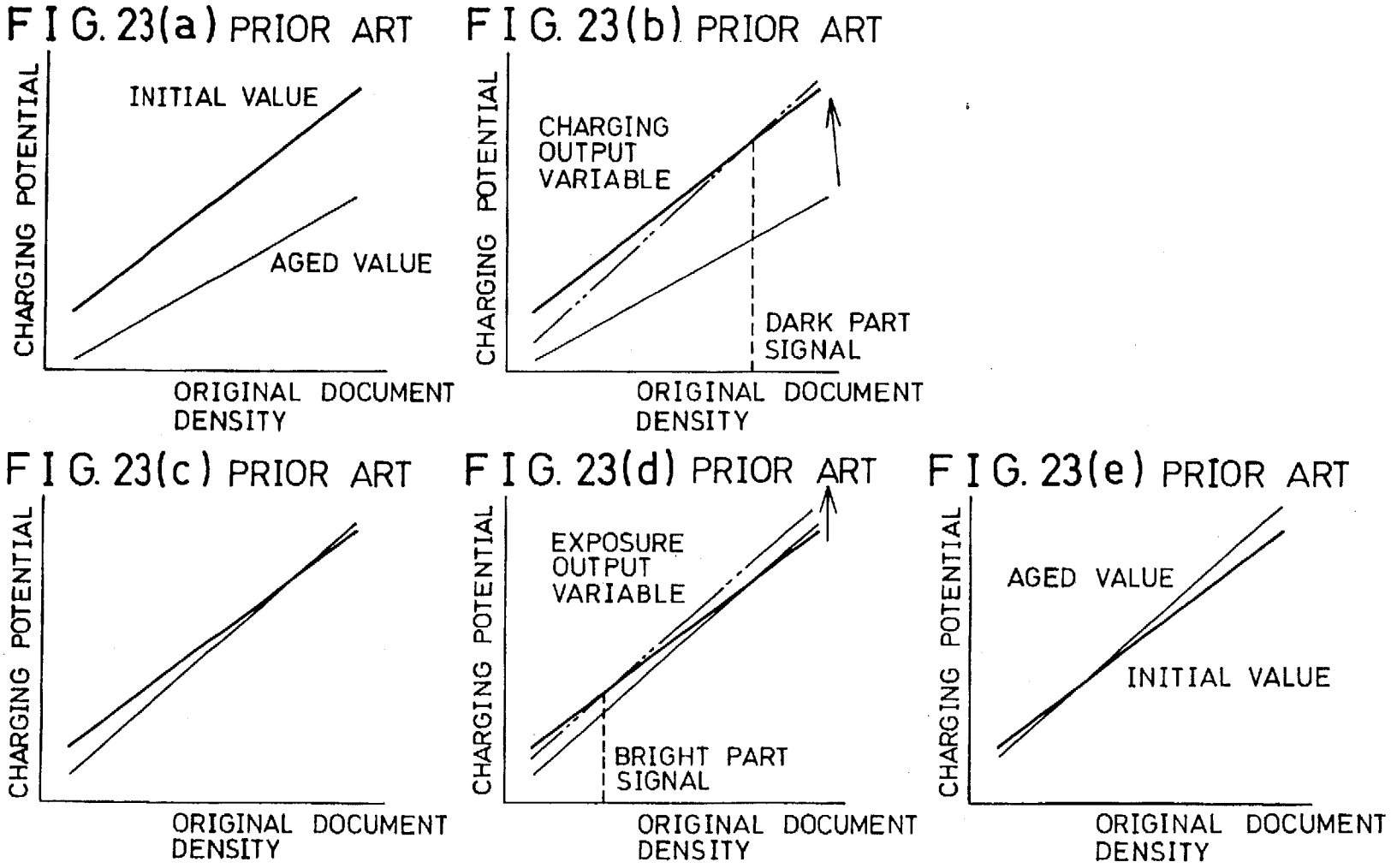
FIG. 23(a) PRIOR ART
INITIAL VALUE
AGED VALUE
CHARGING POTENTIAL
ORIGINAL DOCUMENT DENSITY
FIG. 23(b) PRIOR ART
CHARGING OUTPUT VARIABLE
DARK PART SIGNAL
CHARGING POTENTIAL
ORIGINAL DOCUMENT DENSITY
FIG. 23(c) PRIOR ART
CHARGING POTENTIAL
ORIGINAL DOCUMENT DENSITY
FIG. 23(d) PRIOR ART
EXPOSURE OUTPUT VARIABLE
BRIGHT PART SIGNAL
CHARGING POTENTIAL
ORIGINAL DOCUMENT DENSITY
FIG. 23(e) PRIOR ART
AGED VALUE
INITIAL VALUE
CHARGING POTENTIAL
ORIGINAL DOCUMENT DENSITY

INITIAL VALUE
AGED VALUE
IMAGE DENSITY
ORIGINAL DOCUMENT DENSITY

CHARGING OUTPUT VARIABLE
DARK PART SIGNAL
IMAGE DENSITY
ORIGINAL DOCUMENT DENSITY

IMAGE DENSITY
ORIGINAL DOCUMENT DENSITY

EXPOSURE OUTPUT VARIABLE
BRIGHT PART SIGNAL
IMAGE DENSITY
ORIGINAL DOCUMENT DENSITY

AGED VALUE
INITIAL VALUE
IMAGE DENSITY
ORIGINAL DOCUMENT DENSITY

IMAGE STABILIZER

FIELD OF THE INVENTION

The present invention relates to an image stabilizer which performs process control for stabilizing images produced by an electrophotographic type image forming apparatus, such as a copying machine, a laser printer and a plain paper facsimile, which forms an electrostatic latent image on a photosensitive body and then visualizes the electrostatic latent image with a developer.

BACKGROUND OF THE INVENTION

Conventionally, devices and consumable goods such as a charging device, an exposing device, a photosensitive body and a developer are used in an electrophotographic type image forming apparatus: for example, a copying machine, a laser printer and a plain paper facsimile.

However, these devices and consumable goods are generally very sensitive to, for example, aging and environmental factors such as temperature and humidity. Therefore, these factors easily affect image quality obtained from charging, exposure and development of such a photosensitive body, and thus cause a problem that the image quality varies greatly from image to image.

In order to solve the problem, for example, Japanese Publication for Examined Patent Application No. 61-29502/1986 (Tokukoushou 61-29502) discloses an image stabilizer, incorporated in the electrophotographic type image forming apparatus such as a copying machine, a laser printer and a plain paper facsimile, for stabilizing the image quality by controlling those processes of charging, exposure, development, etc.

In an attempt to stabilize the image quality, the image stabilizer disclosed in the above examined patent application is configured to form a first charged image of a bright part and a second charged image of a dark part by radiating light having a predetermined power onto a photosensitive body whose surface is uniformly charged, and thus obtains a first signal and a second signal respectively corresponding to the first and second charged images. The second signal corresponding to the dark part is used for controlling a charging condition of the photosensitive body, whereas the first signal corresponding to the bright part is used for controlling an exposure condition or a developing condition of the photosensitive body.

In other words, the image stabilizer disclosed in the above examined patent application is configured to stabilize the image quality by controlling the charging condition with the dark part signal obtained from the dark part of an electrostatic latent image and by controlling the exposure condition or the developing condition with the bright part signal obtained from the bright part of the electrostatic latent image.

Generally, $\gamma$ characteristics (charging and image characteristics of the photosensitive body) of the image forming apparatus are variable as shown in FIGS. 19 through 22 by independently changing the charging and exposure conditions of the photosensitive body. The charging characteristics of the photosensitive body can be observed by measurement of a charging potential of the photosensitive body surface. The image characteristics of the photosensitive body can be observed by measurement of a density of a toner image, a visible image produced on the photosensitive body surface, i.e., by measurement of an image density.

FIG. 19 shows correlation between the original document density and the charging potential of the photosensitive body when the exposure condition (exposure output) of the photosensitive body is fixed and the charging condition (charging output) of the photosensitive body is variable. It is understood from FIG. 19 that as the charging output becomes greater, the slope of the function representing the correlation becomes greater. Here, the exposure output refers to, for example, a light source output of a copy lamp, and the charging output refers to, for example, an output of a charging device.

FIG. 20 shows correlation between the original document density and the charging potential of the photosensitive body when the charging output of the photosensitive body is fixed and the exposure output of the photosensitive body is variable. It is understood from FIG. 20 that as the exposure output becomes greater, the function representing the correlation parallelly shifts towards a smaller charging potential.

FIG. 21 shows correlation between the original document density and the image density (density of a toner image produced on the photosensitive body surface) when the exposure output is fixed and the charging output of the photosensitive body is variable. It is understood from the FIG. 21 that as the charging output becomes greater, the slope of the function representing the correlation becomes greater. In such a case where the toner image formed on the photosensitive body is transferred onto transfer paper, the image development reaches a limit (a limit in area gradation) with a certain charging potential or more. That is, since the image density reaches a certain level with a certain charging potential or more, the image density saturates at that level. The image development is considered to have reached the limit, for example, when a Macbeth density meter shows a density of the toner image transferred onto paper of 1.4 or more.

FIG. 22 shows correlation between the original document density and the image density when the charging output of the photosensitive body is fixed and the exposure output is variable. It is understood that as the exposure output becomes greater, the function representing characteristics of the exposure output parallelly moves towards a smaller original document density.

Note that each graph in FIGS. 19 through 22, showing five functions with different characteristics, describes a continuous characteristic change of the photosensitive body with five different fixed outputs.

Referring to FIGS. 23(*a*) through 23(*e*) and 24(*a*) through 24(*e*), the process control for stabilizing the image of the photosensitive body will be discussed. The process control is a control for bringing aged characteristics of the photosensitive body close to initial characteristics. The aged characteristics are the charging or image characteristics, for example, after the photosensitive body is used for a predetermined time. The initial characteristics are the charging or image characteristics in the initial period, for example, right after the photosensitive body is delivered from a factory. Besides, in the following description, the initial characteristics will be referred to as the initial values, while the aged characteristics will be referred to as the aged values.

First, the following description will explain the process control in a case where the bright and dark part signals of the photosensitive body to be measured are obtained from a value obtained from measurement of the charging potential of the photosensitive body.

It is supposed that the potentials of the bright and dark parts of the photosensitive body have different aged values from the initial values as shown in FIG. 23(*a*). First, as shown in FIG. 23(*b*), the charging condition is controlled so that the aged value of the dark part signal obtained from the charging potential corresponding to the dark part of the photosensitive body is equal to the initial value. The resulting correlation of the aged and initial values of the photosensitive body is shown in FIG. 23(*c*). In this case, the control of the charging condition is a control of increasing the charging output.

Then, as shown in FIG. 23(*d*), the exposure condition is controlled so that the aged value of the bright part potential obtained from the charging potential corresponding to the bright part of the photosensitive body is equal to the initial value. The resulting correlation of the aged and initial values of the photosensitive body is shown in FIG. 23(*e*). In this case, the control of the exposure condition is a control of decreasing the exposure output. The control of the exposure condition is completed in this manner.

Next, the following description will explain the process control in a case where the bright and dark part signals of the photosensitive body to be measured are obtained from measured values of the toner image (toner patch) density in a case where the photosensitive body is developed, that is, values of the image density.

It is supposed that the bright and dark part signals obtained from values of the image density of the bright and dark parts of the photosensitive body have different aged values from the initial values as shown in FIG. 24(*a*). First, as shown in FIG. 24(*b*), the charging condition is controlled so that the aged value of the dark part signal of the photosensitive body is equal to the initial value. The resulting correlation of the aged and initial values of the photosensitive body is shown in FIG. 24(*c*). In this case the control of the charging condition is a control of increasing the charging output.

Then, as shown in FIG. 24(*d*), the exposure condition is controlled so that the aged value of the bright part signal of the photosensitive body is equal to the initial value. The resulting correlation of the aged and initial values of the photosensitive body is shown in FIG. 24(*e*). In this case, the control of the exposure condition is a control of decreasing the exposure output. The control of the exposure condition is completed in this manner.

As described above, the conventional image stabilizer is configured to stabilize the image with the above mentioned process control which brings the aged characteristics of the photosensitive body close to the initial characteristics.

Besides, the developing condition (developing bias) may be variable instead of the exposure condition. The apparent exposure is thus controlled by changing a developing potential in accordance with a relation between the charging potential of the exposed photosensitive body and the output of the developing bias. However, in this case, since the developing potential is changed, the image density is also changed. Therefore, the control characteristics of the image density is poor, compared with the case where the charging output, the exposure output, etc. are controlled.

However, as shown in FIGS. 23(*a*) through 23(*e*) and 24(*a*) through 24(*e*), the control carried out by the conventional image stabilizer can only bring the aged characteristics of the photosensitive body close to the initial characteristics. In other words, as shown in FIGS. 23(*e*) and 24(*e*), the conventional image stabilizer can not perform a control which makes the aged characteristics virtually identical to the initial characteristics. Therefore, the conventional image stabilizer can not preserve the initial characteristics of the photosensitive body, which creates a problem of insufficient image stabilization.

SUMMARY OF THE INVENTION

An object of the present invention is to offer an image stabilizer effectively performing image stabilization by making initial and aged characteristics virtually identical with control of retain the initial characteristics of a photosensitive body over a period of time.

In order to accomplish the object, the image stabilizer in accordance with the present invention is an image stabilizer, incorporated in an image forming apparatus which visualizes with a developing agent an electrostatic latent image obtained by exposing original document to light and guiding light reflected at the original document to a charged photosensitive body surface, for stabilizing a formed image by changing a first parameter relevant to control of exposure quantity and a second parameter relevant to control of charging quantity among a plurality of control parameters determining $\gamma$ characteristics of the image forming apparatus, and includes: a first section for measuring an initial value relevant to the second parameter at at least two points in the electrostatic latent image, obtaining from these initial values a first slope value representing a ratio of the $\gamma$ characteristics change to an original document density change, and recording the first slope value; a second section for, after an image process is carried out a predetermined number of times, measuring an aged value which has deviated from the initial value of the second parameter at at least two points in the electrostatic latent image, obtaining from these aged values a second slope value representing a ratio of a $\gamma$ characteristics change to the original document density change, and recording the second slope value; and a correcting section for comparing the first and second slope values recorded in the first and second sections, and performing a second parameter control and a first parameter control, the second parameter control changing the second parameter in accordance with a result of the comparison so that the second slope value is almost equal to the first slope value, the first parameter control changing the first parameter so that at least one of the aged values relevant to the corrected second parameter is almost equal to the initial value corresponding to that aged value.

Generally, an exposure output and a charging characteristic (charging output) has correlation as described below. In a case where the exposure output of the photosensitive body is fixed and the charging output of the photosensitive body is variable, a slope representing a ratio of a charging potential change to the original document density change or a slope representing a ratio of an original document image density change to the original document density change increases with an increase in the charging output. On the contrary, in a case where the charging output of the photosensitive body is fixed and the exposure output of the photosensitive body is variable, the slope representing the ratio of the charging potential change to the original document density change or the slope representing the ratio of the original document image density change to the original document density change parallelly moves towards a smaller charging potential with an increase in the exposure output.

Accordingly, with the above image stabilizer, if, for example, the second parameter relevant to the control of the charging quantity is adopted as the charging output to the photosensitive body, in a case where the aged values are to corrected, first, the first slope value of the initial values relevant to that charging output and the corresponding second slope value of the aged values can be controlled so as to be almost equal to each other by varying the charging output. Thereafter, if, for example, the first parameter relevant to the control of the exposure quantity is adopted as the exposure output to the photosensitive body, at least one of the two aged values relevant to the charging output can be controlled so as to be almost equal to one of the two initial values corresponding to that aged value by varying the exposure output. The initial and aged characteristics of the photosensitive body can be made virtually identical with such two-step correction.

In addition, preferably, the image stabilizer may include: a first section for measuring at least one initial value relevant to the second parameter corresponding to a bright part of the electrostatic latent image and at least one initial value relevant to the second parameter corresponding to a dark part of the electrostatic latent image, and recording those initial values; a second section for, after an image forming process is carried out a predetermined number of times, measuring aged values which have deviated from the initial values of the second parameter, and recording those aged values; and a correcting section for comparing the initial and aged values recorded in the first and second sections, and performing a second parameter control and a first parameter control, the second parameter control changing the second parameter in accordance with a result of the comparison so that a first difference between the initial and aged values corresponding to the bright part is almost equal to a second difference between the initial and aged values corresponding to the dark part with respect to the second parameter, the first parameter control changing the first parameter so that at least one of the aged values relevant to the corrected second parameter is almost equal to the initial value corresponding to that aged value.

Therefore, in a case where the aged values are corrected in the above manner, the initial and aged characteristics of the photosensitive body can be made virtually identical by the control of making the differences between the two initial values for the bright and dark points relevant to the second parameter and the two corresponding aged values for the bright and dark points almost equal to each other. In this case, the slope values, i.e. , the slopes corresponding to the bright and dark parts, do not need to be calculated from data of the initial values as mentioned above, thus facilitating the control and cutting down time required for the control.

For a fuller understanding of the nature and advantages of the invention, reference should be made to the ensuing detailed description taken in conjunction with the accompanying drawings.

BRIEF DESCRIPTION OF THE DRAWINGS

FIGS. 1(*a*) through 1(*e*) are explanatory drawings showing an image stabilizing process performed by an image stabilizer in accordance with an embodiment of the present invention based on a charging characteristic of a photosensitive body.

FIGS. 2(*a*) through 2(*e*) are explanatory drawings showing an image stabilizing process performed by the image stabilizer in accordance with the embodiment of the present invention based on an image characteristic of the photosensitive body.

FIG. 6(*b*) is a graph showing correlation between initial values and aged values showing an image density to an original document density.

FIGS. 23(*a*) through 23(*e*) are explanatory drawings showing an image stabilizing process performed by a conventional image stabilizer based on a charging characteristic of a photosensitive body.

DESCRIPTION OF THE EMBODIMENT

Referring to FIGS. 1(*a*) through 1(*e*), 2(*a*) through 2(*e*), 3 through 5, 6(*a*), 6(*b*), 7 , 8(*a*) through 8(*g*), 9 through 18, 25 and 26, the following description will discuss an embodiment in accordance with the present invention. In the present embodiment, a copying machine will be described as an image forming apparatus incorporating an image stabilizer in accordance with the present invention.

Figure 3:
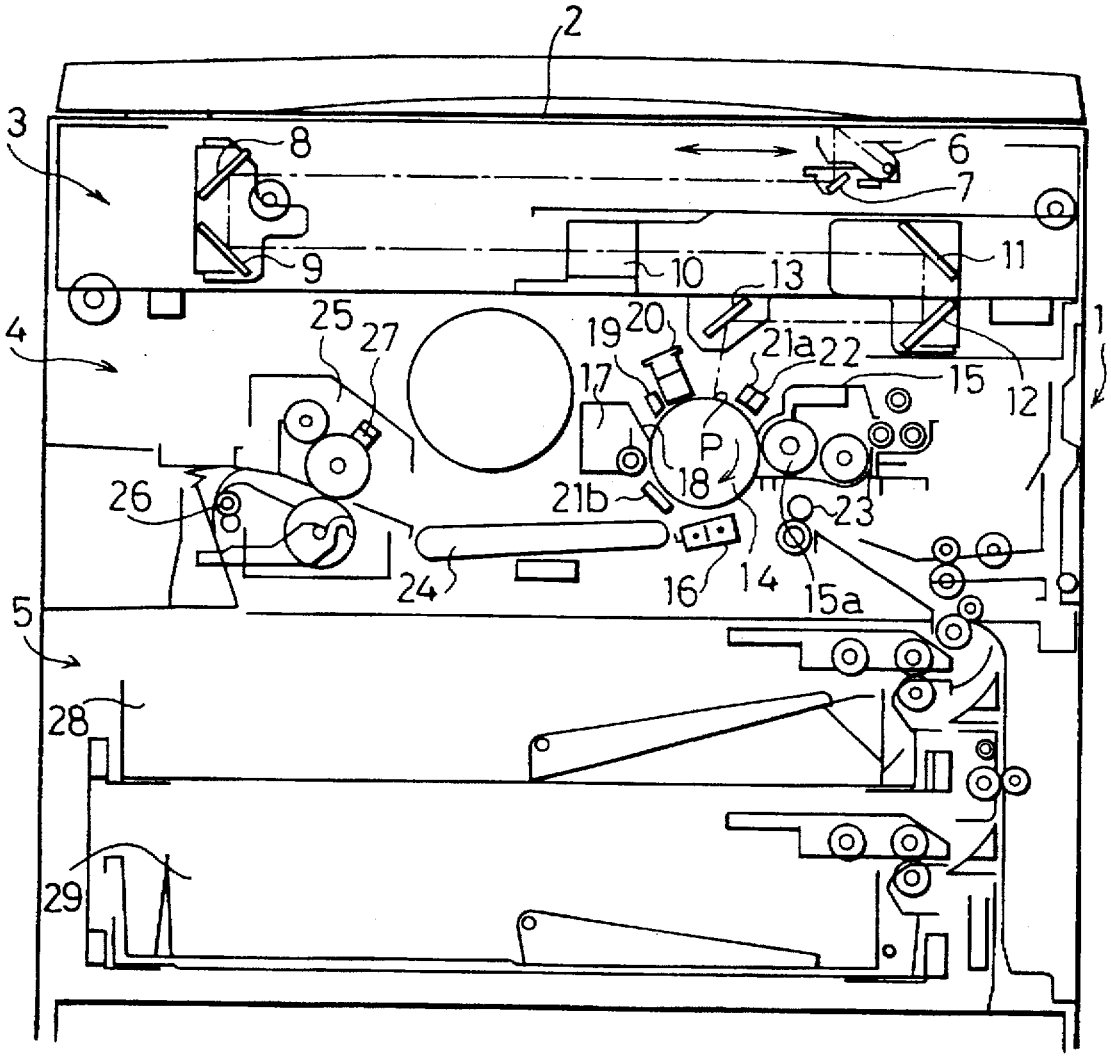
FIG. 3 is a schematic view showing a structure of a copying machine incorporating the image stabilizer shown in FIGS. 1(*a*) through 1(*e*) and 2(*a*) through 2(*e*).

As shown in FIG. 3, the copying machine includes a main body 1. The main body 1 has an original document platen 2 thereon, an exposure optical system 3, an image forming section 4 and a paper feeding section 5 below the original document platen 2.

The exposure optical system 3 is composed of a copy lamp 6, a first mirror 7, a second mirror 8, a third mirror 9, a lens 10, a fourth mirror 11, a fifth mirror 12 and a sixth mirror 13, and is configured so that light radiated from the copy lamp 6 is reflected at the original document platen 2 and then guided to an exposure point P on a photosensitive body 14 (will be discussed later) through the mirrors and lens.

The copy lamp 6 and the first mirror 7 are configured so as to be capable of moving parallelly to the original document platen 2. When an original document (not shown) is placed on the original document platen 2 and a copy start button (not shown) is pressed, the copy lamp 6 and the first mirror 7 move parallelly along the original document platen 2, as shown in FIG. 3, and scan the document placed on the original document platen 2 with light.

The image forming section 4 is provided with the photosensitive body 14 which is composed of organic photo conductors (OPCs). Around the photosensitive body 14 are provided a detecting device 21*a*, a blank lamp 22, a developing device 15, a transfer device 16, a detecting device 21*b*, a cleaning device 17, a cleaning blade 18, a discharging lamp 19 and a charging device 20 in this order from the exposure point P in the rotation direction of the photosensitive body 14 denoted by the arrow. The detecting device 21*a* detects a charging characteristic (charging potential) of a surface of the photosensitive body 14, and is, for example, composed of a surface potential meter. The detecting device 21*b* detects an image characteristic (image density) of the surface of the photosensitive body 14, and is, for example, composed of a reflection type sensor utilizing infrared ray. Generally, a cheap photo interrupter is used as this reflection type sensor. The image density is a density of a toner image, a visible image produced on the surface of the photosensitive body 14, i.e., a visible image density. Even if only one of the detecting devices 21*a* and 21*b* is incorporated in the image stabilizer, the image stabilizer is still capable of performing an image stabilizing process (will be discussed later) accordance with the incorporated detecting device.

On an upstream side of the image forming section 4 in a paper feeding direction is provided a transport roller 23 for transporting paper fed from the paper feeding section 5 to a transfer position located between the photosensitive body 14 and the transfer device 16. On an downstream side of the image forming section 4 in a paper feeding direction is provided a paper transport device 24 for transporting to a fixing device 25 the paper onto which the toner image is transferred.

The fixing device 25 is provided with an ejection roller 26 for ejecting the paper after fixing, and with a fixing temperature detecting section 27 for detecting a fixing temperature of the fixing device 25.

The paper feeding section 5 is provided with paper cassettes 28 and 29 for storing paper of different sizes. The paper feeding section 5 is configured to feed paper to the image forming section 4 selectively from the paper cassettes 28 and 29 in accordance with the paper size.

In the copying machine configured in the above manner, the light radiated from the copy lamp 6 is reflected by the original document (not shown) on the original document platen 2 and radiated to the exposure point P on the surface of the photosensitive body through the first mirror 7, the second mirror 8, the third mirror 9, the lens 10, the fourth mirror 11, the fifth mirror 12, and the sixth mirror 13.

The surface of the photosensitive body 14 is uniformly charged in advance by the charging device 20, and an electrostatic latent image is formed on that surface by the above-mentioned radiated light. The electrostatic latent image is visualized into a toner image by the developing device 15 after the blank lamp 22 is selectively turned on to cancel unnecessary charge. The toner image is transferred by the transfer device 16 onto the paper fed via the transport roller 23 from either of paper cassettes 28 and 29.

The paper onto which the toner image is transferred is transported by the paper transport device 24 to the fixing device 25, where the toner image is fixed to the paper. After fixing, the paper is ejected outside by the ejection roller 26.

Meanwhile, toner that is not used for the transfer is left on the photosensitive body 14 after the toner image is transferred. Therefore, the photosensitive body 14 is configured so that the cleaning blade 18 of the cleaning device 17 cleans the remaining toner image on the surface, and then the discharging lamp 19 cancels all the charge on the surface.

Figure 9:
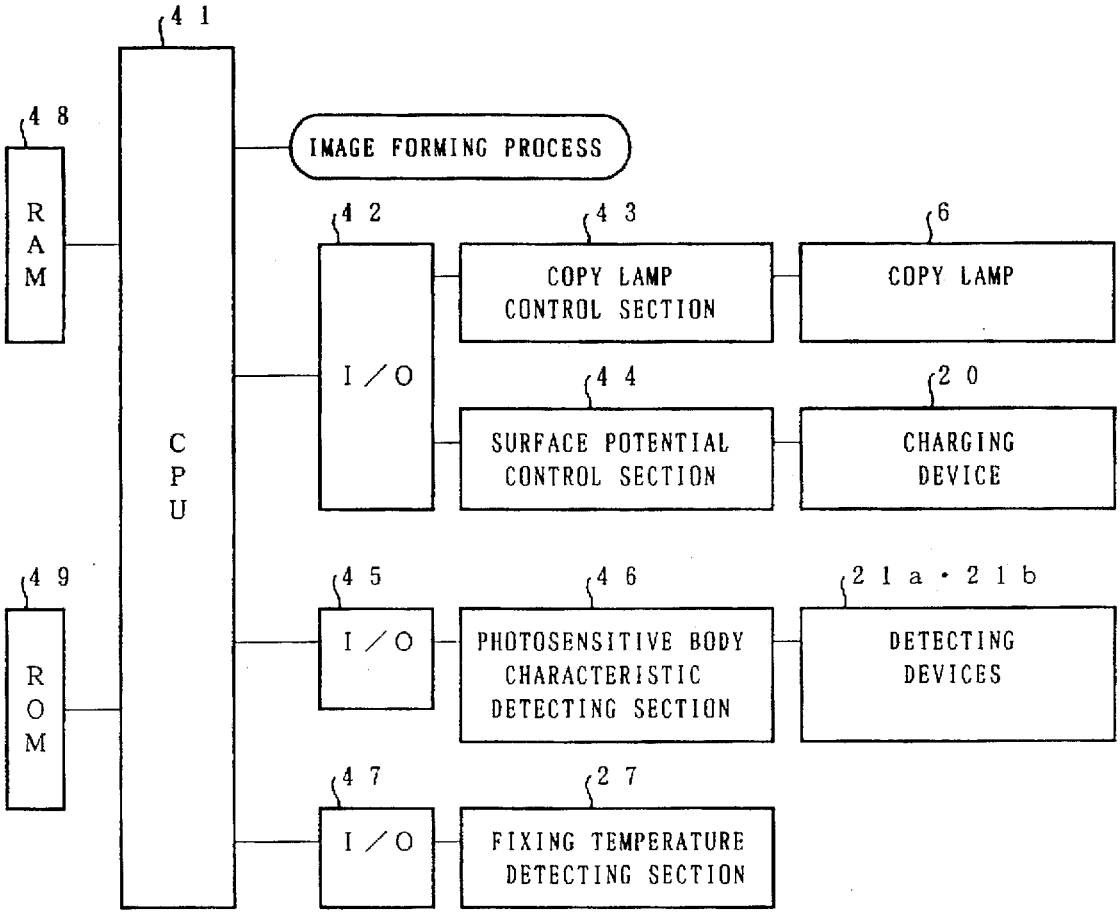
FIG. 9 is a block diagram showing a control device incorporated in the copying machine shown in FIG. 3.

The process explained so far is an ordinary image forming process of the present copying machine, and the process is controlled by a central processing unit (CPU, control means) 41 illustrated in FIG. 9. Details of the CPU 41 will be discussed later.

Moreover, apart from the above image forming process, the present copying machine also performs an image stabilizing process. The image stabilizing process compensates for γ characteristics (charging and image characteristics of the photosensitive body) of the image forming apparatus of, for example, a copying machine. Specifically, the image stabilizing process is a process of controlling and compensating for the unstable charging and image characteristics of the surface of the photosensitive body 14 caused by deterioration due to aging and by environmental factors such as temperature and humidity. Besides, the image stabilizing process is normally carried out regularly under predetermined conditions (every predetermined number of copied sheets, every predetermined period of time) with the above image forming process suspended temporarily.

As discussed so far, the image stabilizing process is carried out because the γ characteristics deteriorates. In other words, the charging and image characteristics of the surface of the photosensitive body 14 after a specified period of time (hereinafter, will be referred to as the aged characteristics) are different from the charging and image characteristics thereof at the initial period, e.g., right after the copying machine is manufactured (hereinafter, will be referred to as the initial characteristic). Generally, the aged characteristics of the photosensitive body 14 are worse than the initial characteristics thereof, and the charging and image characteristics of the photosensitive body 14 deteriorate. Therefore, in an attempt to stabilize the image formed on the photosensitive body 14, an image formed by the photosensitive body 14 is adjusted to be in the same state as in the initial state by performing the image stabilizing process of carrying out a first parameter control of varying a light source output (exposure output (first parameter)) of the copy lamp 6 as well as carrying out a second parameter control of varying the charging output (second parameter) by the charging device 20 to the photosensitive body 14.

Moreover, the image stabilizing process is carried out not only regularly as already mentioned, but also when the copying machine is powered on.

Right after power-on, inside temperature of the copying machine is low, and temperature of the fixing device 25 is also often lower than a temperature suitable for fixing (e.g., 80° C.). If the photosensitive body 14 and a developer are left for a long period of time in such a low temperature state, characteristics thereof may differ from those in the ordinary state. In order to solve this, the copying machine detects the temperature of the fixing device 25 with the fixing temperature detecting section 27, judges whether the detected temperature exceeds the above-mentioned specific temperature (e.g., 80° C.). If the detected temperature exceeds the specific temperature, the copying machine proceeds to a stand-by state to perform the image forming process (copying stand-by state), whereas if the detected temperature does not exceed the specific temperature, the copying machine performs the image stabilizing process. By thus performing the image stabilizing process when the copying machine is powered on, the image is prevented from being affected from the above mentioned environmental characteristics to temperature, humidity, etc.

Figure 4:
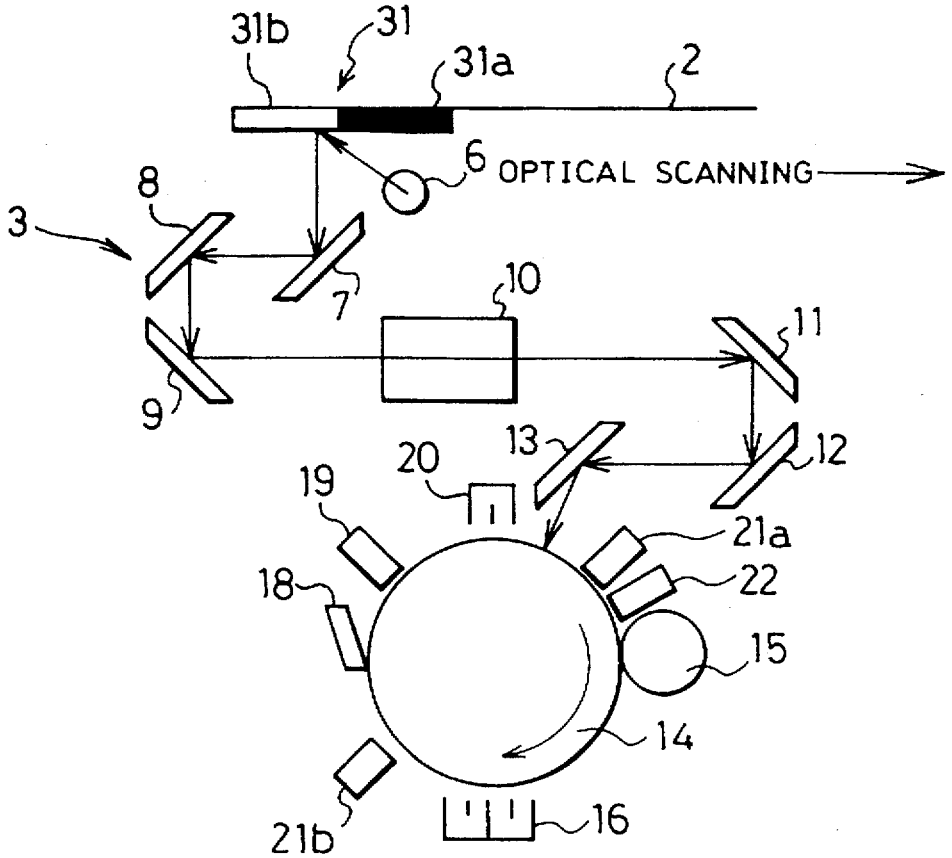
FIG. 4 is an explanatory drawing showing a process layout of the image stabilizer incorporated in the copying machine shown in FIG. 3.
Figure 5:
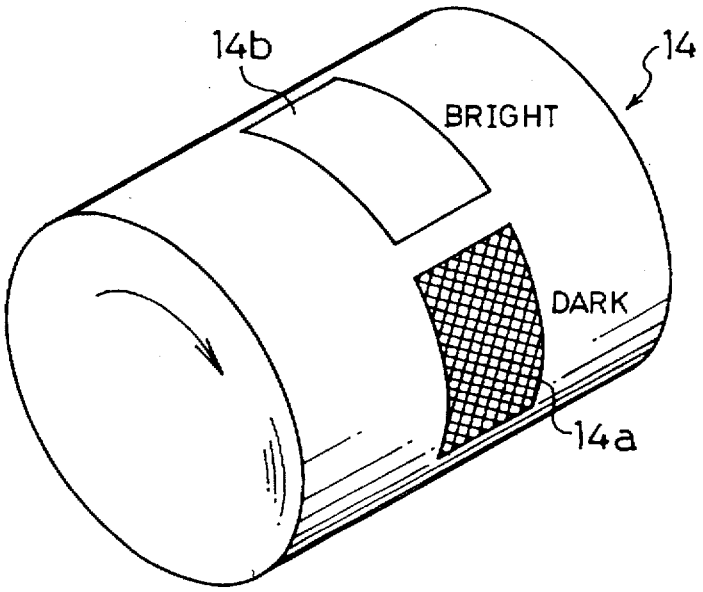
FIG. 5 is a perspective view of a photosensitive body on which a bright part and a dark part are formed in the image stabilizing process shown in FIG. 4.

Referring to FIGS. 4 and 5, the following description will discuss the image stabilizing process. The present image stabilizing process is controlled by a CPU 41 as control means (will be discussed later). Also, in the present image stabilizing process, the γ characteristics of the image forming apparatus are measured with charging potential of the electrostatic latent image of the photosensitive body 14 or with toner image (toner patch) density developed from the electrostatic latent image.

When the image stabilizing process is performed by the above-mentioned copying machine, first, for example, as shown in FIG. 4, the copy lamp 6 and the first mirror 7 are moved while light is being radiated from the copy lamp 6 at a standard plate 31, composed of a dark standard plate 31*a* and a bright standard plate 31*b*, disposed in a neighborhood of an original document placement side of the original document platen 2, and then the reflected light is guided onto the photosensitive body 14 via the exposure optical system 3. Here, it is supposed that the photosensitive body 14 is uniformly charged by the charging device 20 at a fixed voltage, and the copy lamp 6 is turned on at the fixed voltage.

The optical scanning by the copy lamp 6 is performed from the dark standard plate 31*a* of the standard plate 31 towards the bright standard plate 31*b* of the standard plate 31. As a result, an electrostatic latent image is formed in the rotation direction (the direction denoted by the arrow) on the surface of the photosensitive body 14, as shown in FIG. 5, where a dark part area (hereinafter, will be simply referred to as a dark part) 14*a* corresponding to the dark standard plate 31*a* and a bright part area (hereinafter, will be simply referred to as a bright part) 14*b* corresponding to the bright standard plate 31*b* are clearly distinguished.

The fixed voltage for the copy lamp 6 and the charging device 20 in this case is not particularly specified, but is preferably equal to a median value of a voltage used in an actual image forming process.

Next, the charging characteristic of the photosensitive body 14 on which the electrostatic latent image as shown in FIG. 5 is detected with the detecting device 21*a* composed of, for example, the surface potential meter. In other words, the charging potentials of the electrostatic latent image are detected at two points in the bright and dark parts formed on the photosensitive body 14 by the detecting device 21*a* composed of the surface potential meter. Then, since the charging potential of the photosensitive body 14 is no longer necessary after the detection, the blank lamp 22 is fully powered on to discharge the photosensitive body 14.

A detection signal corresponding to the charging potential detected by the detecting device 21*a* is defined as an aged value. The aged value is compared with a detection signal corresponding to the charging potential of the photosensitive body 14 which is recorded as an initial value in advance in an initial setting stage of the copying machine.

Based on comparison results of the bright and dark points of the aged values and the initial values, the charging condition of the photosensitive body 14 is controlled. That is, a variation between the aged value and the initial value is obtained for the bright part 14*b* and for the dark part 14*a*, and the variations are then compared with each other. If the variation in the dark part 14*a* is greater than that in the bright part 14*b*, an output of the charging device 20 is controlled, using the variation in the bright part 14*b* as a reference, so that the variations in the bright part 14*b* and in the dark part 14*a* becomes equal to each other. The following will describe such a control of the charging condition for the above mentioned case where the variation in the dark part 14*a* is greater than that in the bright part 14*b*. The case where the variation in the bright part 14*b* is greater than that in the dark part 14*a* will be discussed later.

In the control of the charging condition, first, optimum charging condition (that is, charging output with which the variations in the bright part 14*b* and in the dark part 14*a* are equal to each other) is determined in accordance with the variation in the bright part 14 *b* while, for example, the output of the charging device 20 (charging output), which is the second parameter relevant to the control of the γ characteristics of the image forming apparatus, is being controlled at 30 V interval.

After the above control of the charging condition is performed, the photosensitive body 14 is uniformly charged by the charging device 20 under the determined charging condition, the copy lamp 6 is turned on with the fixed voltage, light is radiated at only the dark standard plate 31*a* of the standard plate 31 disposed on a tip of the original document platen 2, the reflected light is guided to the photosensitive body 14 via the exposure optical system 3, and an electrostatic latent image corresponding to the dark standard plate 31*a* is formed on the photosensitive body 14. Note that the fixed voltage for the copy lamp 6 in this case is not particularly specified, but is preferably equal to the median value of the voltage used in the actual image forming process.

Next, an exposure condition is controlled in the same manner as in the above mentioned control of the charging condition. In this control, the charging potential of an electrostatic latent image in the dark part 14*a* formed on the photosensitive body 14 is detected as an aged value by the detecting device 21*a* composed of the surface potential meter. The detected aged value is then compared with a detection signal corresponding to the charging potential of the photosensitive body which is recorded as the initial value in advance in an initial setting stage of the copying machine.

Based on comparison results of the aged and initial values, the light source output (exposure output) of the copy lamp 6 is controlled so that the detected value of the dark part 14*a* is almost equal to the initial value of the dark part 14*a*. In the control of the exposure condition in this case, first, for example, the light source output of the copy lamp 6, which is the first parameter of the control of the γ characteristics of the image forming apparatus, is controlled at 1 V interval. Next, optimum exposure condition (that is, exposure output with which the detected value of the dark part 14 *a* and the initial value of the dark part 14*a* are equal to each other) is determined from calculation for straight line approximation of exposure conditions of these two points.

In the description above, although the charging potential corresponding to the dark part signal has been used to control the exposure condition, it is also possible to use a bright part signal to control the exposure condition.

Referring to the FIGS. 1(*a*) through 1(*e*), the following description will further discuss the image stabilizing process. Note that in the FIGS. 1(*a*) through 1(*e*), among the electrostatic latent images formed on the photosensitive body 14 with the standard plate 31, a signal obtained by measuring the charging potential of the dark part 14*a* with the detecting device 21*a* is shown as the dark part signal, and a signal obtained by measuring the charging potential of the bright part 14*b* with the detecting device 21*a* is shown as the bright part signal. Besides, original document densities (bright and dark standard plate densities) corresponding respectively to these signals and the approximation straight line based on the charging potential are shown as the initial values (denoted by thick lines in FIGS. 1(*a*) through 1(*e*)) and the aged values (denoted by thin lines in FIGS. 1(*a*) through 1(*e*)).

First, it is supposed, as an example, that the initial and aged values of the bright and dark part signals of the photosensitive body 14 are correlated with each other in such a manner that the variation between the initial and aged values of the dark part signal (dark part variation Δ: hereinafter will be referred to as dark Δ) is greater than the variation between the initial and aged values of the bright part signal (bright part variation Δ: hereinafter will be referred to as bright Δ), as shown in FIG. 1(*a*). In such an example, the charging characteristic of the aged value is controlled by changing the charging output to the photosensitive body 14 (second parameter) as shown in FIG. 1(*b*) so that the bright Δ and the dark Δ become equal to each other as shown in FIG. 1(*c*).

Next, as shown in FIG. 1(*d*), the exposure output (first parameter) is controlled so that the aged value of the dark part signal is equal to the initial value. As a result, the aged value becomes virtually identical to the initial value as shown in FIG. 1(*e*).

Note that the above wording "virtually identical" implies that the aged value is not necessary corrected to be completely equal to the initial value. Practically, the aged and initial values are corrected with some allowable difference left uncorrected which human eyes can not recognize.

In the above image stabilizing process, the image stabilizing control is carried out by measuring the surface potential of the electrostatic latent image formed in the dark part 14*a* and the bright part 14*b* on the photosensitive body 14. However, the charging characteristic of the photosensitive body 14 is not necessarily determined in the above manner, i.e., by measuring the surface potential with respect to the electrostatic latent image. The charging characteristic of the photosensitive body 14 may be also determined in other manners: for example, by measuring the density of the toner patch formed on the photosensitive body 14 by developing the above electrostatic latent image.

In this case, the density of the toner patch formed on the photosensitive body 14 is measured with the detecting device 21*b* composed of a photo interrupter as a reflection type sensor disposed between the transfer device 16 and the cleaning device 17 of the photosensitive body 14 as shown in FIGS. 3 and 4. The bright and dark part signals corresponding to the density of the toner patch are thus detected as shown in FIG. 2(*a*) .

The above image stabilizing process utilizing the density of the toner patch formed on the surface of the photosensitive body 14 is controlled in the same manner as the previously mentioned image stabilizing process utilizing the surface potential of the photosensitive body 14.

That is, it is supposed, as an example, that the initial and aged values of the bright and dark part signals based on the toner patch density are correlated with each other in such a manner that the variation between the initial and aged values of the dark part signal (dark Δ) is greater than the variation between the initial and aged values of the bright part signal (bright Δ), as shown in FIG. 2(*a*). In such an example, the charging condition for the aged value is controlled by changing the charging output to the photosensitive body 14 (second parameter) as shown in FIG. 2(*b*) so that the respective bright Δ and the dark Δ of the toner patches in the bright and dark parts become equal to each other as shown in FIG. 2(*c*).

Next, as shown in FIG. 2(*d*), the exposure output (first parameter) is controlled so that the aged value of the toner patch in the dark part is equal to the initial value. As a result, the aged value becomes virtually identical to the initial value as shown in FIG. 2(*e*). The aged and initial values are denoted respectively by thin lines and thick lines in FIGS. 2(*a*) through 2(*e*).

Figure 7:
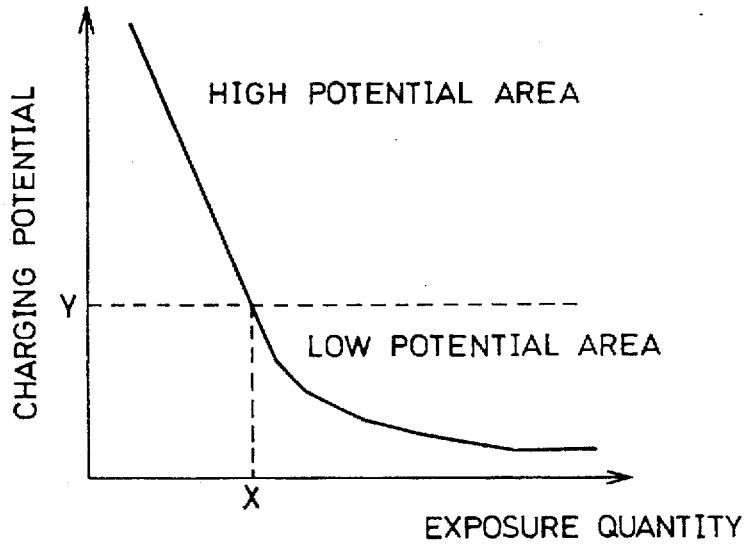
FIG. 7 is a graph showing correlation between an exposure quantity and a charging potential.
Figure 8A:
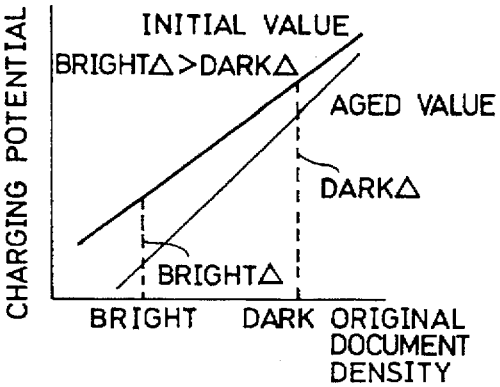
FIGS. 8(*a*) through 8(*g*) are explanatory drawings showing another image stabilizing process performed by an image stabilizer in accordance with another embodiment of the present invention based on a charging characteristic of a photosensitive body.
Figure 8B:
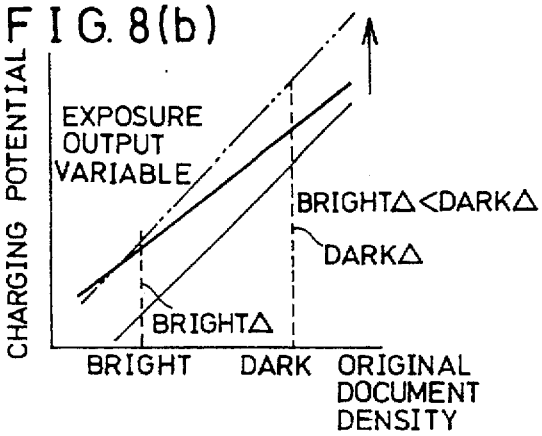
Figure 8C:
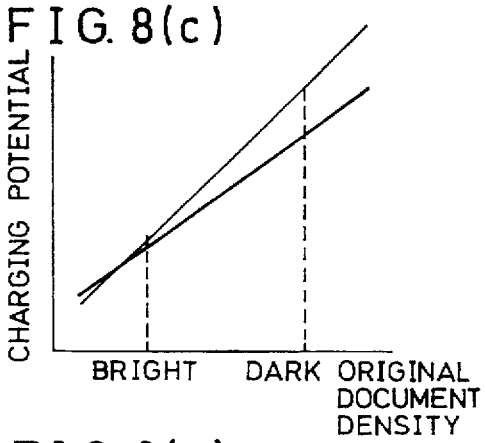
Figure 8D:
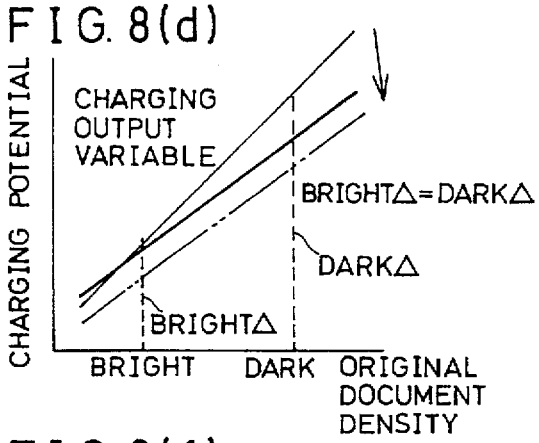
Figure 8E:
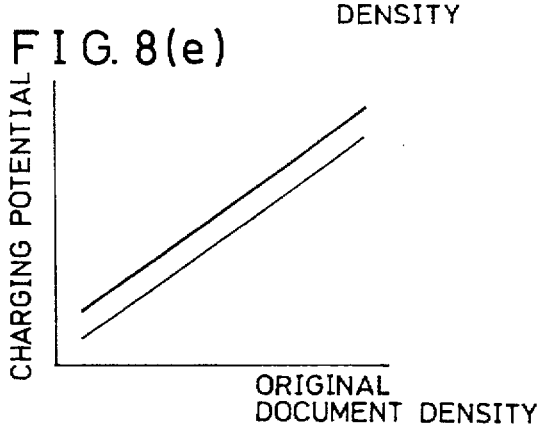
Figure 8F:
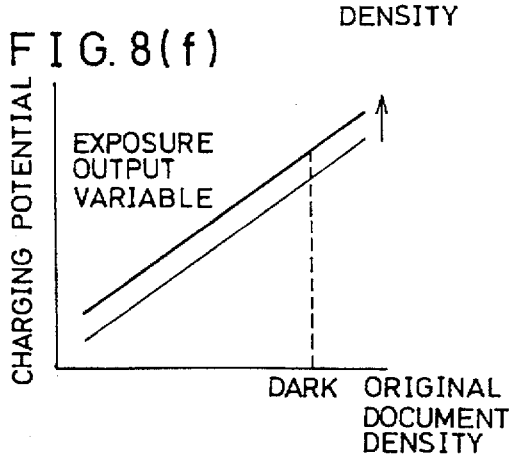
Figure 8G:
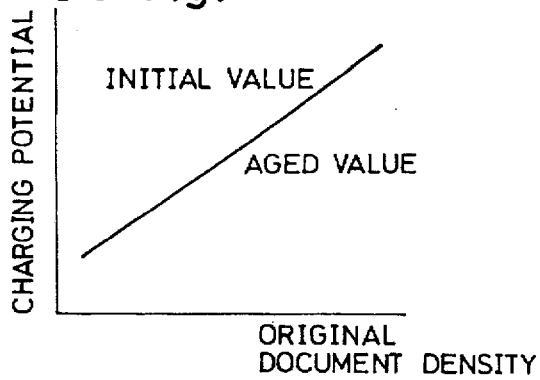

Generally, the charging characteristic of the photosensitive body 14 differs in a high potential area and in a low potential area which are separated by a predetermined charging potential Y as shown in FIG. 7. In other words, the ratio of a exposure quantity change to a charging potential change differs in the high potential area and in the low potential area of the charging potential. Therefore, when the exposure condition is controlled, the aged value may not be controlled with respect to the initial value as it is intended to be.

Figure 6A:
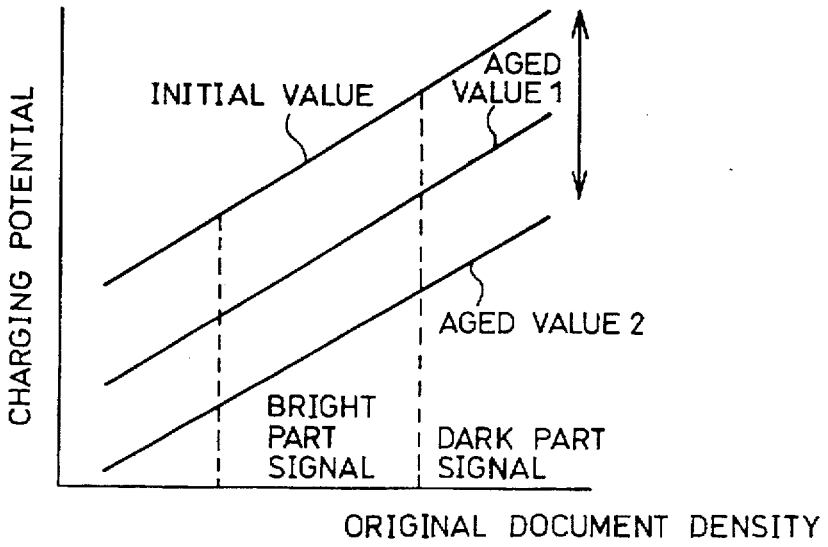
FIG. 6(*a*) is a graph showing correlation between initial values and aged values showing a charging potential to an original document density.
Figure 6B:
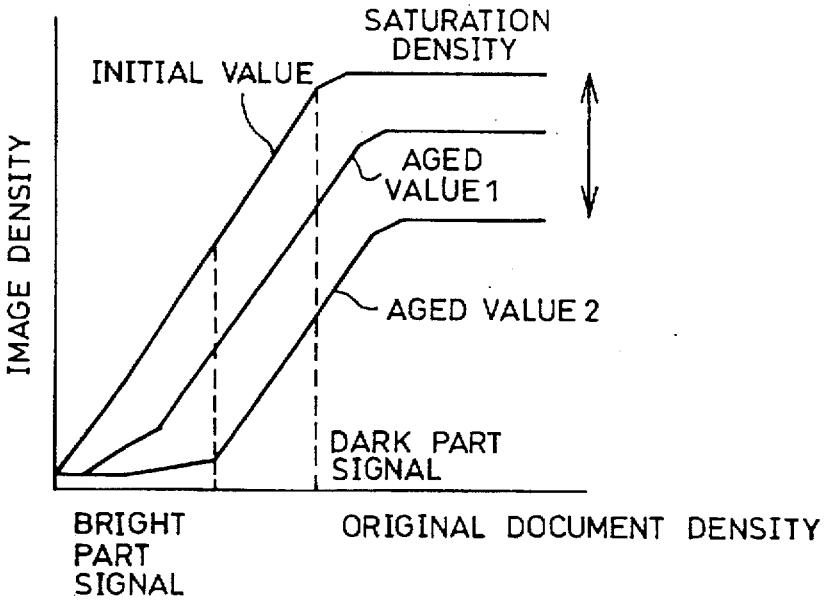

For example, in a case where a difference between the measured aged and initial values of the charging potential of the photosensitive body 14 are very great, especially when the variation between the initial value and the measured aged value in the dark part (the dark Δ) is smaller than the variation between the initial value and the measured aged value in the bright part (the bright Δ), if the charging condition is controlled in the above manner, the aged value of the charging potential is controlled to be equal to aged value 1 or 2 with respect to the initial value as shown in FIG. 6(*a*), and the aged value of the image density is controlled to be equal to aged value 1 or 2 with respect to the initial value as shown in FIG. 6(*b*). The aged values may be corrected to be far different from the initial values in this manner, as the difference between the initial and the aged values becomes greater.

If the aged values are corrected to be far different from the initial values in this manner, it becomes difficult to stabilize the image for the following reason. In a case where the signals are to be obtained from the bright and dark part potentials (charging potential) of the photosensitive body 14, from the above mentioned correlation shown in FIG. 7, exposure quantity controlled in the exposure condition control is greater than X (an exposure quantity corresponding to the charging potential Y separating the high potential area and the low potential area), and the aged value controlled through charging with respect to the initial value is further misplaced. Note that, as to the image density also, the aged value controlled with respect to the initial value may be misplaced as shown in FIG. 6(*b*), in the same manner as in the case of the charging potential.

Figure 21:
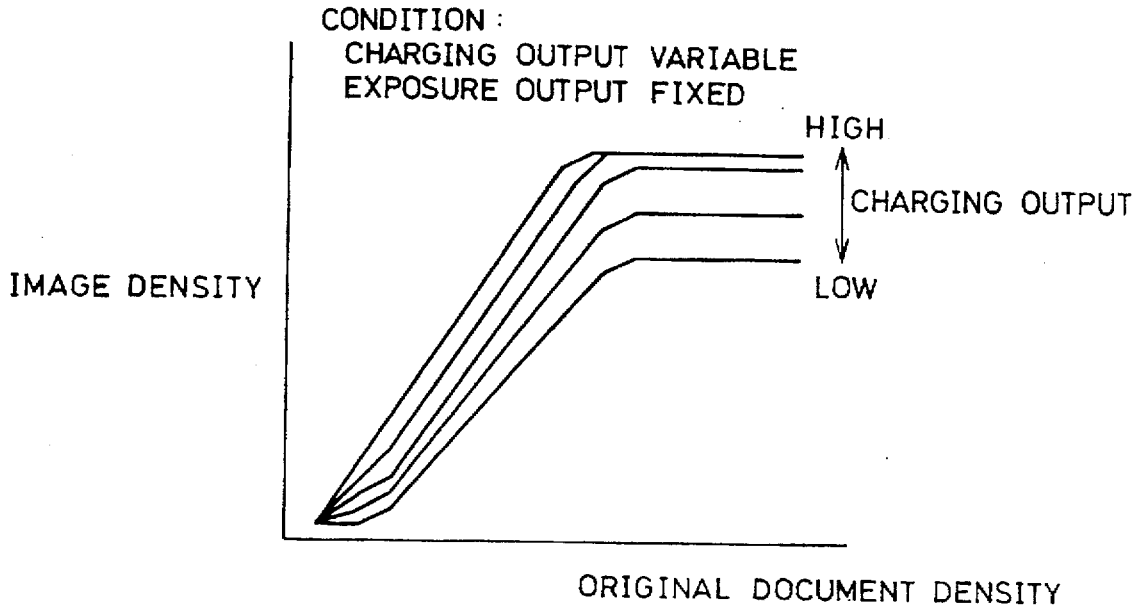
FIG. 21 is an explanatory drawing showing an image characteristic of the photosensitive body when only the charging output is variable.
Figure 22:
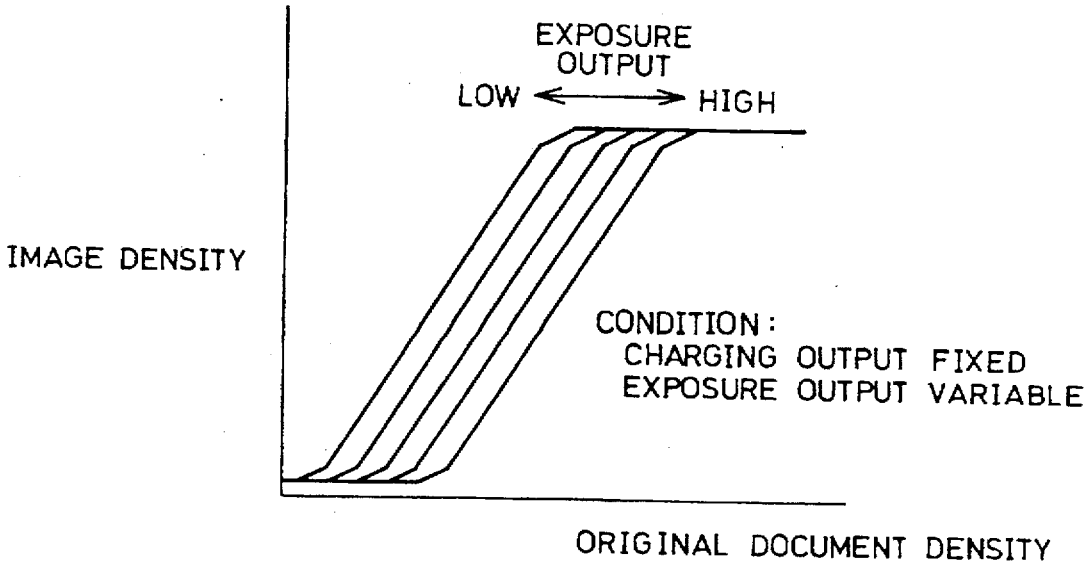
FIG. 22 is an explanatory drawing showing the image characteristic of the photosensitive body when only the exposure output is variable.
Figures 24A, 24B, 24C, 24D, 24E:
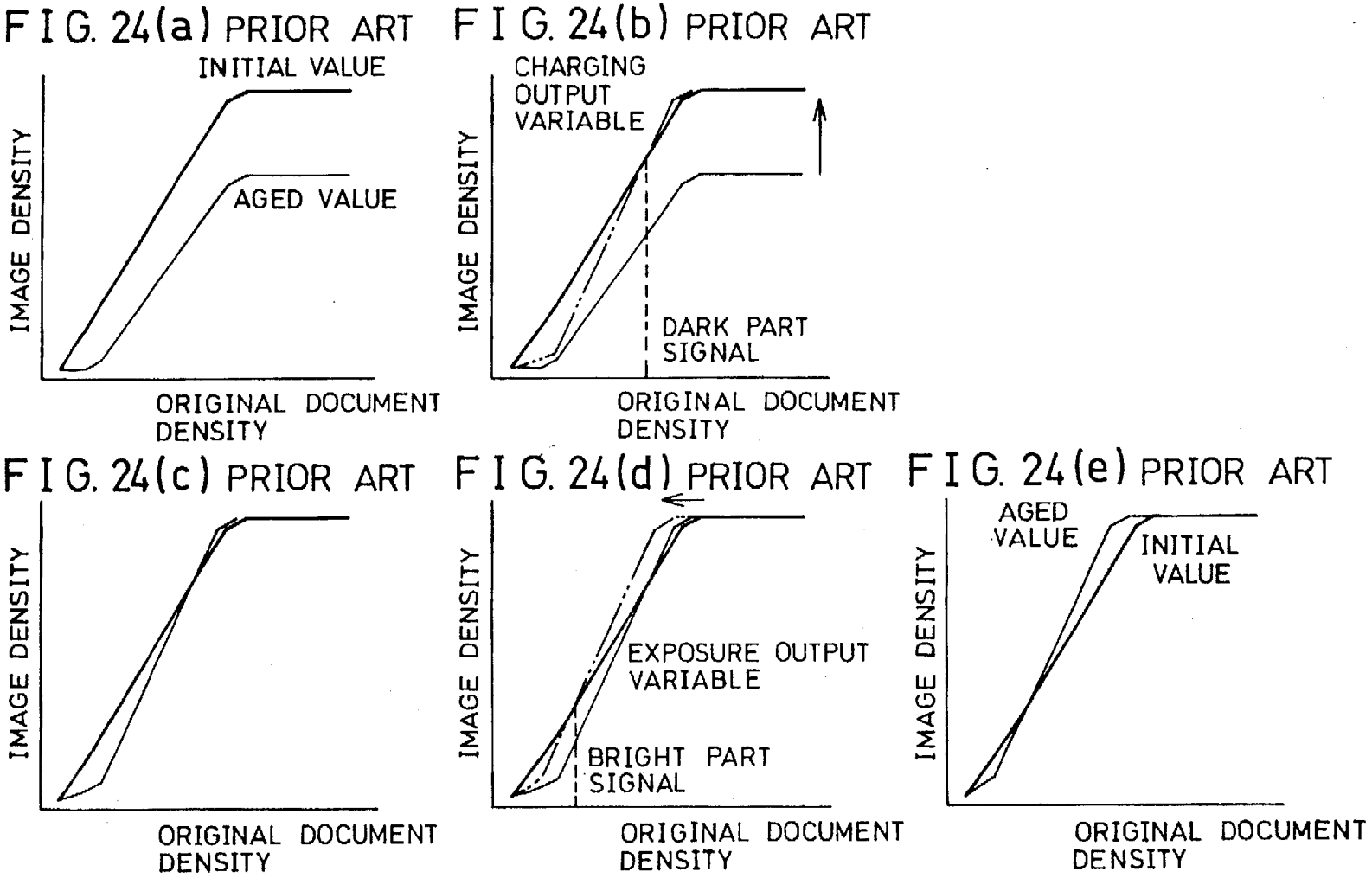
FIG. 24(a) PRIOR ART
FIG. 24(b) PRIOR ART
FIG. 24(c) PRIOR ART
FIG. 24(d) PRIOR ART
FIG. 24(e) PRIOR ART
FIGS. 24(*a*) through 24(*e*) are explanatory drawings showing an image stabilizing process performed by the conventional image stabilizer based on an image characteristic of the photosensitive body.

Moreover, in a case where the signals are to be obtained from the densities (image densities) of the toner image (toner patch) developed from the bright and dark parts of the electrostatic latent image on the photosensitive body 14, since saturation density varies depending on the charging potential of the photosensitive body 14 as shown in FIG. 21 illustrating prior art, when the charging condition is controlled, the aged value (the aged density) controlled through charging with respect to the initial value (the initial density) may be controlled to be far different from the initial value.

In order to solve this, as mentioned above, the variations (bright and dark Δs) between the initial values and the measured aged values (surface potential or image density) in the bright and dark parts are compared. If the dark Δ is smaller than the bright Δ, it is contemplated to control the light source output of the copy lamp 6 with the bright Δ as a reference, so that the dark Δ becomes greater than the bright Δ.

According to the above control, when the dark Δ is smaller than the bright Δ, first, the exposure output (the light source output of the copy lamp 6) is changed so that the dark Δ is greater than the bright Δ and then the control method illustrated in FIGS. 1(*a*) through 1(*e*) is applied.

In the output control of the copy lamp 6, for example, differences between the bright and dark signals of the aged value and the respective bright and dark signals of the initial value may be compared by, for example, changing the output of an exposure device at 1 V interval in order to determine the exposure conditions of two points where the dark Δ is greater than (or equal to) the bright Δ. Then, the optimum exposure condition is determined from calculation for straight line approximation to the exposure conditions of these two points.

Referring to FIGS. 4 and 8(*a*) through 8(*g*), the following description will discuss the image stabilizing process when the dark Δ is smaller than the bright Δ.

First, as shown in FIG. 8(*a*), when the bright Δ is greater than the dark Δ from the correlation between the aged values and the initial values of the charging potential, the exposure output (light source output of the copy lamp 6) is changed as shown in FIG. 8(*b*) so that the bright Δ is smaller than the dark Δ. The resulting state of the aged values are shown in FIG. 8(*c*). Then the photosensitive body 14 is discharged.

Next, as shown in FIG. 8(*d*), the charging output (output of the charging device 20) is changed so that the bright Δ and the dark Δ are equal to each other. The resulting state of the aged values are shown in FIG. 8(*e*).

Then, only the dark part is exposed in a state where the surface of the photosensitive body 14 is uniformly charged with the charging output specified in the above manner, and the exposure output is changed according to the dark part signal obtained from measurement of the dark part as shown in FIG. 8(*f*). Thus the aged values are made virtually identical to the initial values as shown in FIG. 8(*g*).

Meanwhile, if the dark Δ is greater than the bright Δ, and if the bright Δ is not greater than a predetermined value, the aged values can be made virtually identical to the initial values by performing only the charging condition control, which is a control to make the bright and dark Δ s equal to each other. In this manner, the control to be performed after the aforementioned charging condition control (that is, the control of the exposure condition based on the dark Δ) can be omitted. Therefore, the control is simplified and takes less time.

The image stabilizing process discussed so far is controlled by the CPU 41 as control means as shown in FIG. 9. That is, the CPU 41 is connected via an I/O 42 with a copy lamp control section 43 for controlling the light source output of the copy lamp 6 and a surface potential control section 44 for controlling the charging output of the charging device 20, via an I/O 45 with a photosensitive body characteristic detecting section 46 for detecting characteristics of the photosensitive body 14, such as a surface state of the photosensitive body 14, from detection outputs of the detecting device 21*a* and the detecting device 21*b*, and via an I/O 47 with the fixing temperature detecting section 27.

Moreover, the CPU 41 is connected with, as memory means, an RAM 48 for temporarily recording results of the detection by the photosensitive body characteristic detecting section 46, and an ROM 49 for recording various processing programs for the image stabilization. The RAM 48 is configured to have a back-up function, and thus can maintain the initial values of the characteristics of the photosensitive body 14 even if the copying machine is powered off.

In other words, the CPU 41 is configured to compare and calculate the above detection results (aged values) and the detection results (initial values) recorded in the RAM 48 in advance, and to perform the processing program recorded in the ROM 49 in accordance with those results.

The CPU 41 is configured to specify, by performing the processing program, the light source output (exposure output) of the copy lamp 6, which is the first parameter for correcting the γ characteristics of the copying machine, and the output (charging potential) of the charging device 20, which is the second parameter, and to output the above mentioned specified values to the copy lamp control section 43 and the surface potential control section 44 connected via the I/O 42.

The CPU 41 is also configured to include copied sheet counting means for counting the number of copied sheets and to perform the image stabilizing process when the number of copied sheets exceeds the predetermined number.

In other words, the CPU 41 includes: first means (first processing section) for measuring and recording at least one initial value with respect to the second parameter in accordance with the respective bright and dark parts of the electrostatic latent image; second means (second processing section) for measuring and recording aged values having deviated from the initial values of the second parameter after a predetermined quantity of the image forming process; and correction means (correction section) for performing a second parameter control to compare the initial and aged values recorded by the first and second means and then change, based on the comparison results, the second parameter so that a first difference (bright Δ) between the initial and aged values corresponding to the bright part with respect to the second parameter is almost equal to a second difference (dark Δ) between the initial and aged values corresponding to the dark part, and for performing a first parameter control to change the first parameter so that at least one of the aged values with respect to the corrected second parameter is almost equal to the initial value corresponding to this aged value.

Referring to control flow charts shown in FIGS. 10 through 16, the following description will discuss a control of the image stabilization by the present copying machine. The present control is conducted based on the previously mentioned processing programs recorded in the ROM 49.

Figure 10:
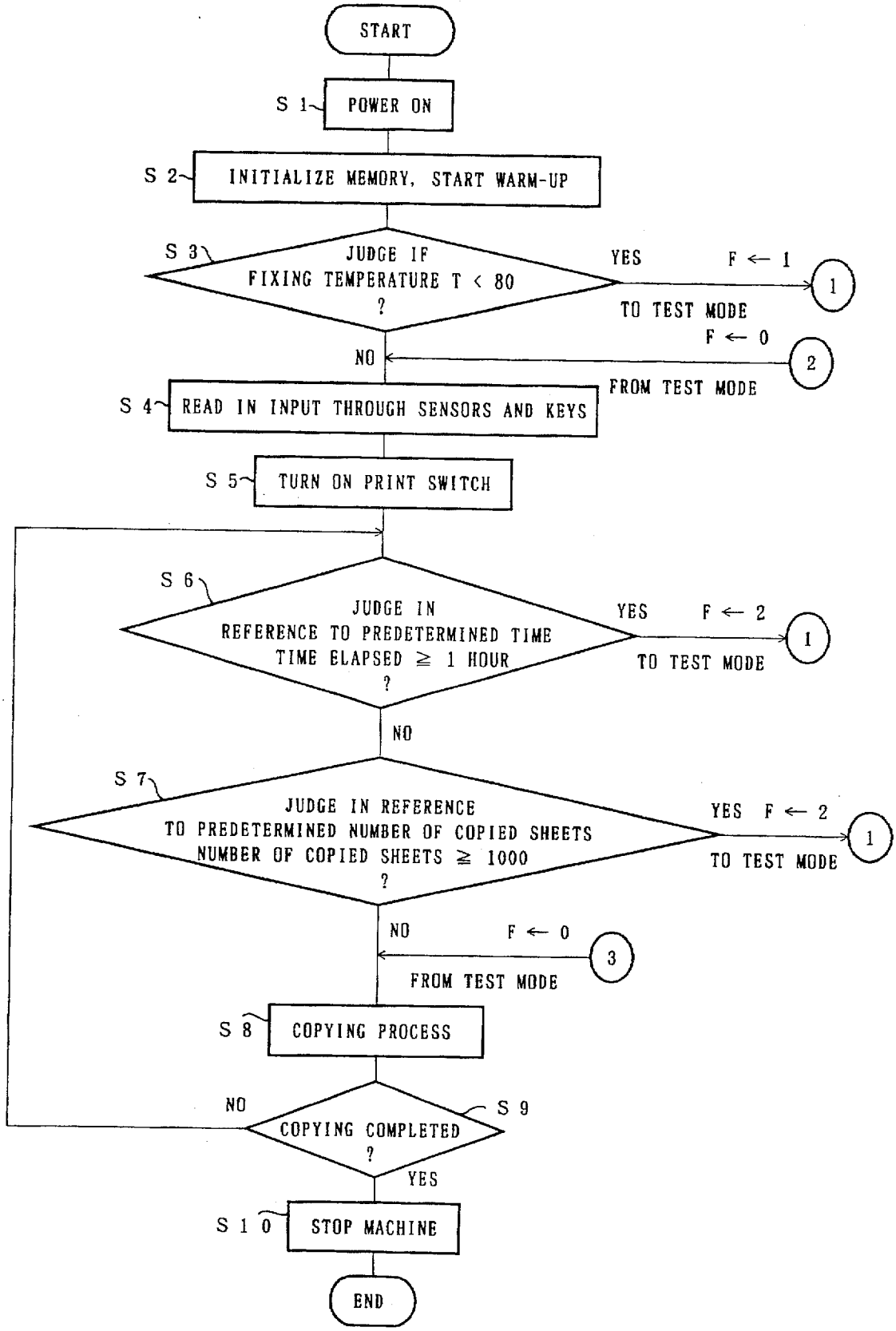
FIG. 10 is a control flow chart of the copying machine shown in FIG. 3.

First of all, referring to the flow chart in FIG. 10, a main processing program will be discussed. As a main body of the copying machine is powered on (S1), the CPU 41 initializes an aged value recording area (memory) of the RAM 48, carries out a preparatory operation process, and starts warm-up (temperature rise) of the fixing device 25 (S2). Right after the start of the warm-up, the CPU 41 detects the temperature of the fixing device 25 with the fixing temperature detecting section 27 and judges whether the detected temperature T is lower than 80° C. (S3). If the detected temperature T is lower than 80° C., the CPU 41 concludes that the main body of the copying machine is not in use, thus proceeding to S11 shown in FIG. 11 to carry out the image stabilizing process (hereinafter, will be referred to as the test mode) for setting the charging potential (output of the charging device 20) of the photosensitive body 14, the exposure output (light source output of the copy lamp 6), etc. When proceeding to the test mode, the CPU 41 sets a return destination flag F to 1: when returning to the main control after the test mode is completed, the CPU 41 initializes the return destination flag F. The return destination flag F denotes to which part of the main control the CPU 41 should return from the test mode.

In S3, if the detected temperature T is not lower than 80° C., the CPU 41 concludes that the main body (machine) of the copying machine is in use or right after use, thus reading in copying conditions (copy mode, number of copied sheets, etc.) inputted through various sensors and keys of the main body of the copying machine to carry out a pre-copying process Next, after carrying out the pre-copying process, as a print switch for starting copying is tuned on (S5), the CPU 41 again judges whether or not the above mentioned test mode will be performed according to references such as the predetermined period of time and the predetermined number of copied sheets (details discussed in the following).

First, the CPU 41 judges whether the predetermined period of time (for example, 1 hour) has elapsed since the last test mode (S6). If 1 hour has elapsed, the CPU 41 proceeds to S11 shown in FIG. 11 to carry out the test mode. Otherwise, the CPU 41 judges whether the copying machine has performed copying of not less than the predetermined number of copied sheets (for example, 1000 sheets) since the last test mode (S7). If the copying machine has performed copying of not less than 1000 sheets, the CPU 41 proceeds to S11 shown in FIG. 11 to carry out the test mode. Otherwise, the CPU 41 carries out a copying process (S8). When proceeding to the test mode from S6 or S7, the CPU 41 sets the return destination flag F to 2: when returning to the main control after the test mode is completed, the CPU 41 initializes the return destination flag F.

Next, the CPU 41 judges whether the copying is completed (S9). In other words, the CPU 41 judges whether the copying process is completed under the copying conditions, such as the copy mode and the number of copied sheets, specified in S4. If the copying is not completed, the CPU 41 proceeds to S6, carrying out the test mode in accordance with the specified conditions while carrying out the copying process. If it is judged in S9 that the copying is completed, the CPU 41 stops the copying operation (machine) (S10).

Next, referring to FIGS. 1(*e*) through 1(*e*), 2(*a*) through 2(*e*), 4, 8(*a*) through 8(*g*), and 11 through 16, the following description will discuss the above mentioned test mode.

Figure 11:
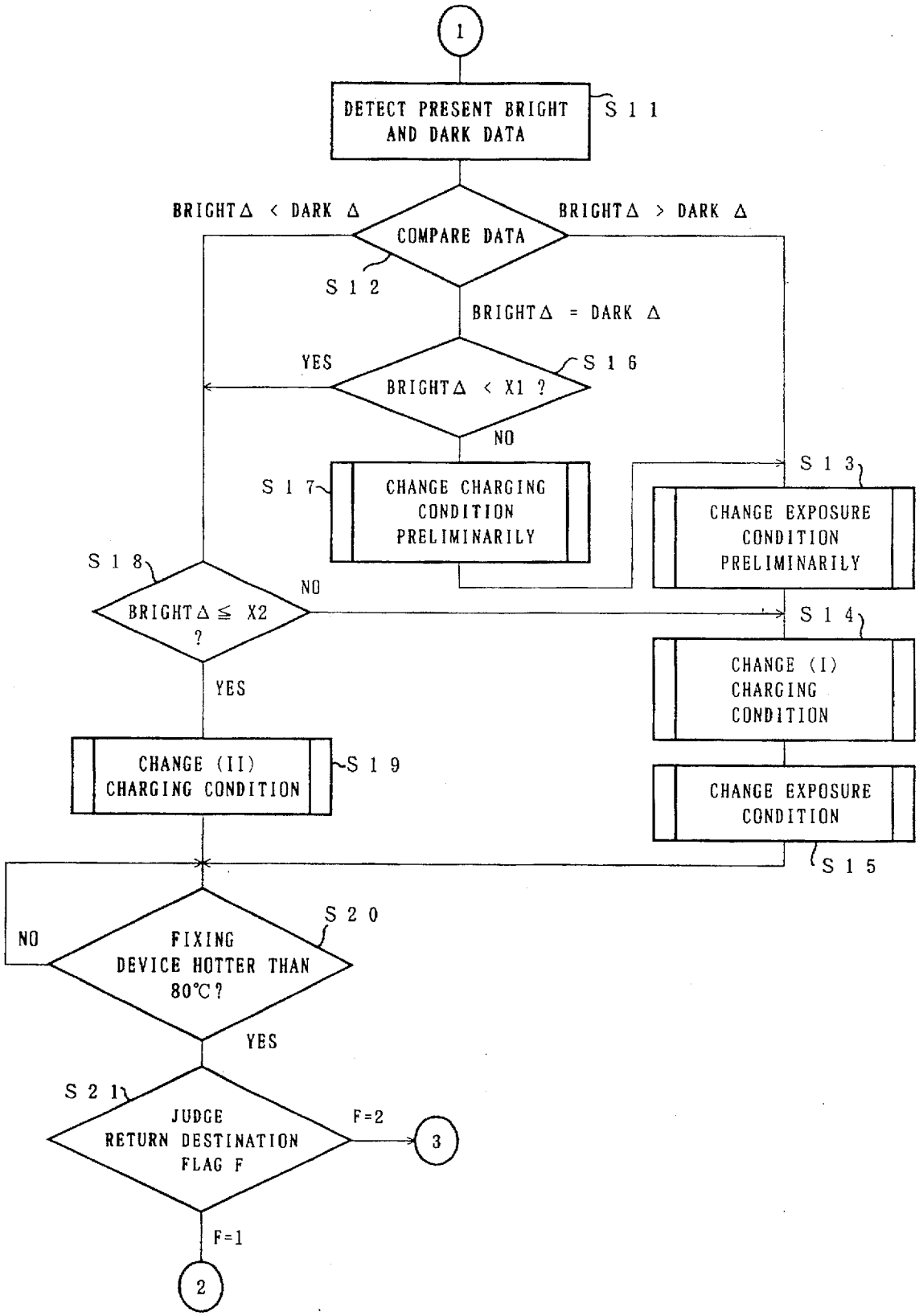
FIG. 11 is a control flow chart of the image stabilizer incorporated in the copying machine shown in FIG. 3.

First, as shown in FIG. 11, the CPU 41 carries out the image stabilizing process shown in FIG. 4, forms the electrostatic latent image of the dark part 14*a* and the bright part 14*b* on the photosensitive body 14, detects the charging potentials of the dark part 14*a* and the bright part 14*b* with the detecting device 21*a* , and reads in the detection signals as present data of the bright and dark part area (bright and dark data) (S11).

Then the CPU 41 calculates the differences between the read-in bright and dark data and the corresponding initial values recorded in the RAM 48 in advance, and compares the data, i.e., the bright variation (bright Δ), which is the first difference of the electrostatic latent image, and the dark variation (dark Δ), which is the second difference of the electrostatic latent image (S12) .

If the bright Δ is greater than the dark Δ in S12, the CPU 41 proceeds to a subroutine (will be discussed later) of preliminarily changing the exposure condition (S13), a subroutine (will be discussed later) of changing (I) the charging condition (S14), a subroutine (will be discussed later) of changing the exposure condition (S15), and the judges the return destination flag F in S21. This part of the control is illustrated in FIGS. 8(*a*) through (*g*).

Meanwhile, if the bright Δ is equal to the dark Δ in S12, the CPU 41 compares the bright Δ with a predetermined value X1 (S16). The predetermined value X1 is greater than a predetermined value X2 (will be discussed later).

If the bright Δ is smaller than the predetermined value X1 in S16, the CPU 41 proceeds to S18. If the bright Δ is equal to or greater than X1, the CPU 41 carries out a subroutine (will be discussed later) of preliminarily changing the charging condition (S17), and then proceeds to S13.

If the bright Δ is smaller than the dark Δ in S12, the CPU 41 compares the bright Δ with the predetermined value X2 (S18). If the bright Δ is greater than the predetermined value X2, the CPU 41 proceeds to S14: if the bright Δ is equal to or smaller than the predetermined value X2, the CPU 41 carries out a subroutine (II) (will be discussed later) with respect to the charging condition (S19). Thereafter, the CPU 41 judges whether the temperature of the fixing device 25 is not less than 80° C. (S20). If the temperature of the fixing device 25 is not less than 80° C., the CPU 41 judges the return destination flag F (S21). If F=1 in S21, the CPU 41 initializes the return destination flag F and then proceeds to S4 in FIG. 10. If F=2 in S21, the CPU 41 initializes the return destination flag F and then proceeds to S8 in FIG. 10.

The predetermined value X2 may be either determined according to human visual characteristics, or mechanically determined so as to be smaller than a width of the smallest memory of an exposure adjustment memory of the copying machine. This is because to a user, the present value (aged value) only needs to seem almost equal to the initial value after the image stabilizing process is completed. In the following description, the aged value will be referred to as the present value for the sake of convenience in description. That is, comparison between the present and initial values means comparison between the aged and initial values.

Next, the subroutines mentioned in the above control flow chart will be discussed in detail.

Figure 12:
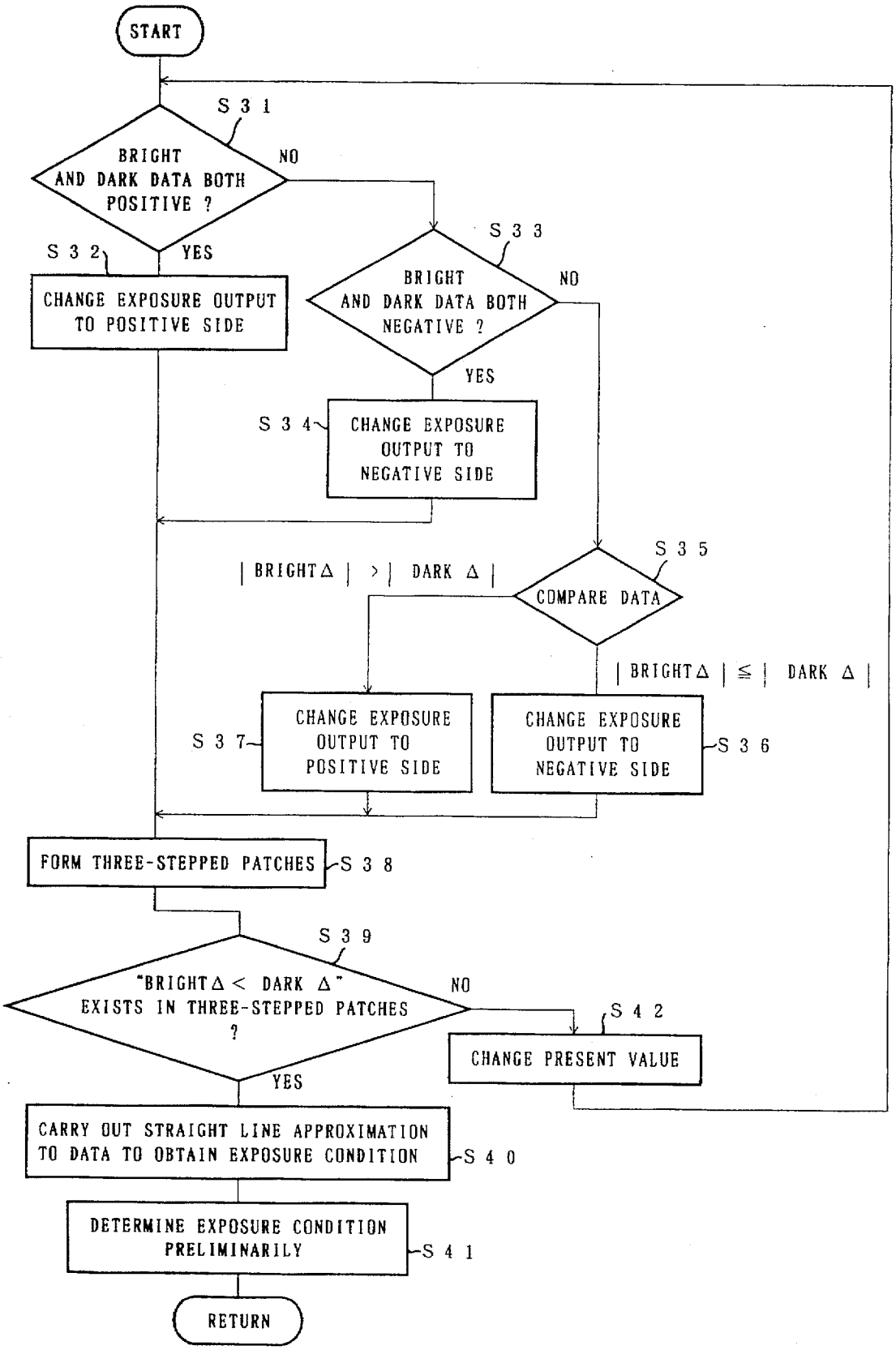
FIG. 12 is a flow chart showing a subroutine of preliminarily changing an exposure condition in the control flow chart shown in FIG. 11.

First, referring to FIG. 12, the subroutine of preliminarily changing the exposure condition (S13 in FIG. 11) will be discussed.

First, the CPU 41 compares the present values of the charging potential in the bright and dark parts (bright and dark data) of the electrostatic latent image detected in S11 in FIG. 11 and the initial values respectively corresponding to the bright and dark data, in order to judge whether both the bright and dark data are greater than the initial values, that is, whether both the bright and dark data are positive (S31). If the bright and dark data are positive, the CPU 41 determines to change the light source output (hereinafter, will be referred to as exposure output) of the copy lamp 6 to the positive side (S32), and then proceeds to S38 (will be discussed later).

If not both the bright and dark data are positive in S31, the CPU 41 judges whether both the bright and dark data are smaller than the initial values, that is, whether both the bright and dark data are negative (S33). If both the bright and dark data are negative, the CPU 41 determines to change the exposure output to the negative side (S34), and then proceeds to S38 (will be discussed later).

If not both the bright and dark data are negative (S33), the CPU 41 compares the variations between the initial values and the bright and dark data, that is, the absolute value of the bright part variation (bright Δ) and the absolute value of the dark part variation (dark Δ) (S35). If the absolute value of the bright Δ is smaller than or equal to the absolute value of the dark Δ, the CPU 41 determines to change the exposure output to the negative side (S36), and then proceeds to S38 (will be discussed later). If the absolute value of the bright Δ is greater than the absolute value of the dark Δ, the CPU 41 determines to change the exposure output to the positive side (S37), and then proceeds to S38 (will be discussed later).

In S38, the exposure output is shifted by a step and two steps, ±1 V at a step, to either the positive or negative side as determined in S32, S34, S36, or S37 to produce two exposure outputs. The CPU 41 then forms three-stepped toner patches on the photosensitive body 14 developed from electrostatic latent images in the bright and dark parts of the present value and of those two exposure outputs. The two exposure outputs, not including the present value, are voltage values of predetermined exposure changes. One step corresponds to, for example, a voltage for one step in manually changing the density of the copying machine. The charging condition here is the same as in the initial period. In other words, in S38, bright and dark toner patches corresponding to three exposure outputs (i.e., the present value, ±1 V, and ±2 V) are formed on the photosensitive body 14.

Next, the CPU 41 detects densities of the toner patches formed as above (image densities) with .the detecting device **21*b*, and judges whether there exists the condition of "the bright Δ<the dark Δ" in a density range expressed by the detected three-stepped patches (S39). If that condition exists in the density range, the CPU 41 carries out a straight line approximation with data corresponding to the three-stepped patches, thereby obtaining the exposure output (S40). The CPU 41 then preliminarily determines the exposure condition and proceeds to S14 in FIG. 11** (S41).

On the other hand, if the above condition does not exist in the density range expressed by the detected three-stepped patches in S39, the CPU 41 changes the present value (S42) and proceeds to S31. In this case, for example, if the above condition is on the positive side from the above density range, the CPU 41 again carries out, using the two-step-increased value as the present value, the subroutine of preliminarily changing the exposure condition.

Figure 17:
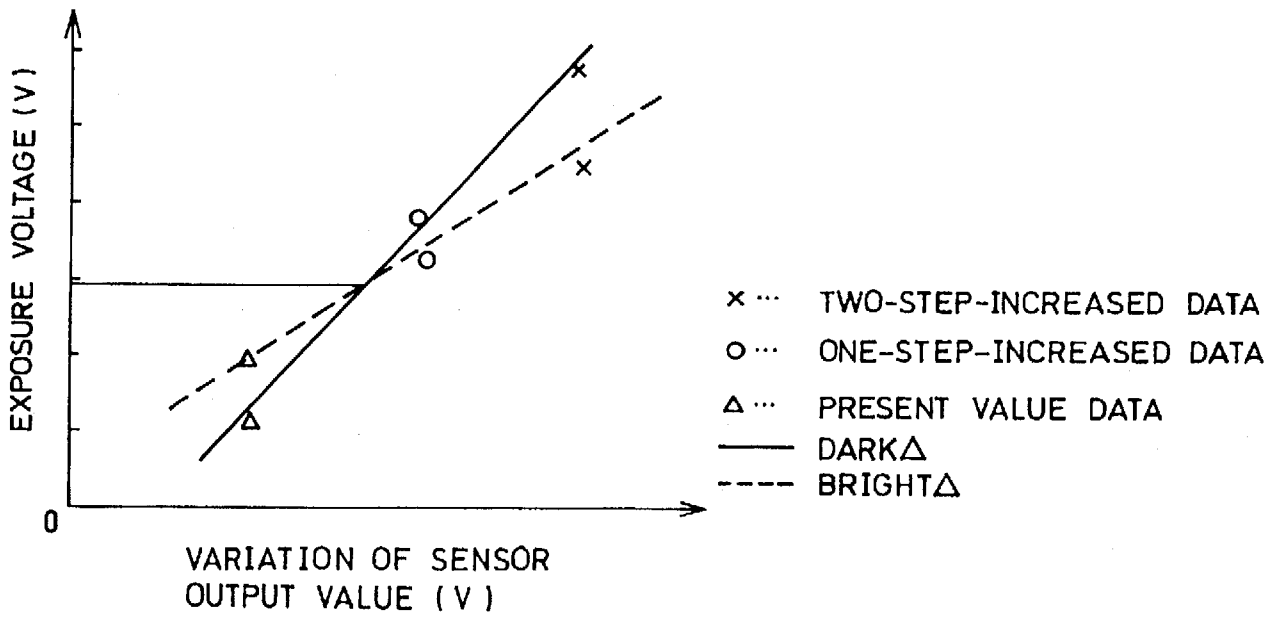
FIG. 17 is a graph showing correlation between an exposure voltage and a sensor output value explaining approximation to an exposure output.

Referring to FIG. 17, the following description will discuss the approximation to the exposure output in S40.

Correlation graphs expressing correlation between the exposure voltages (V) for forming the toner patches of the present value and of the other two steps on the surface of the photosensitive body 14, and the differences between reflective densities (sensor output values (V)) of the toner patches formed as above and the initial values (bright and dark Δs) are obtained. FIG. 17 shows such two correlation graphs respectively corresponding to the bright and dark Δs. Here, the present value and the data obtained by increasing the exposure output by plus one step and plus two steps from the present value are used. An exposure voltage corresponding to the condition, "the bright Δ<the dark Δ (or the bright Δ=the dark Δ)", is obtained from the correlation graphs.

Figure 13:
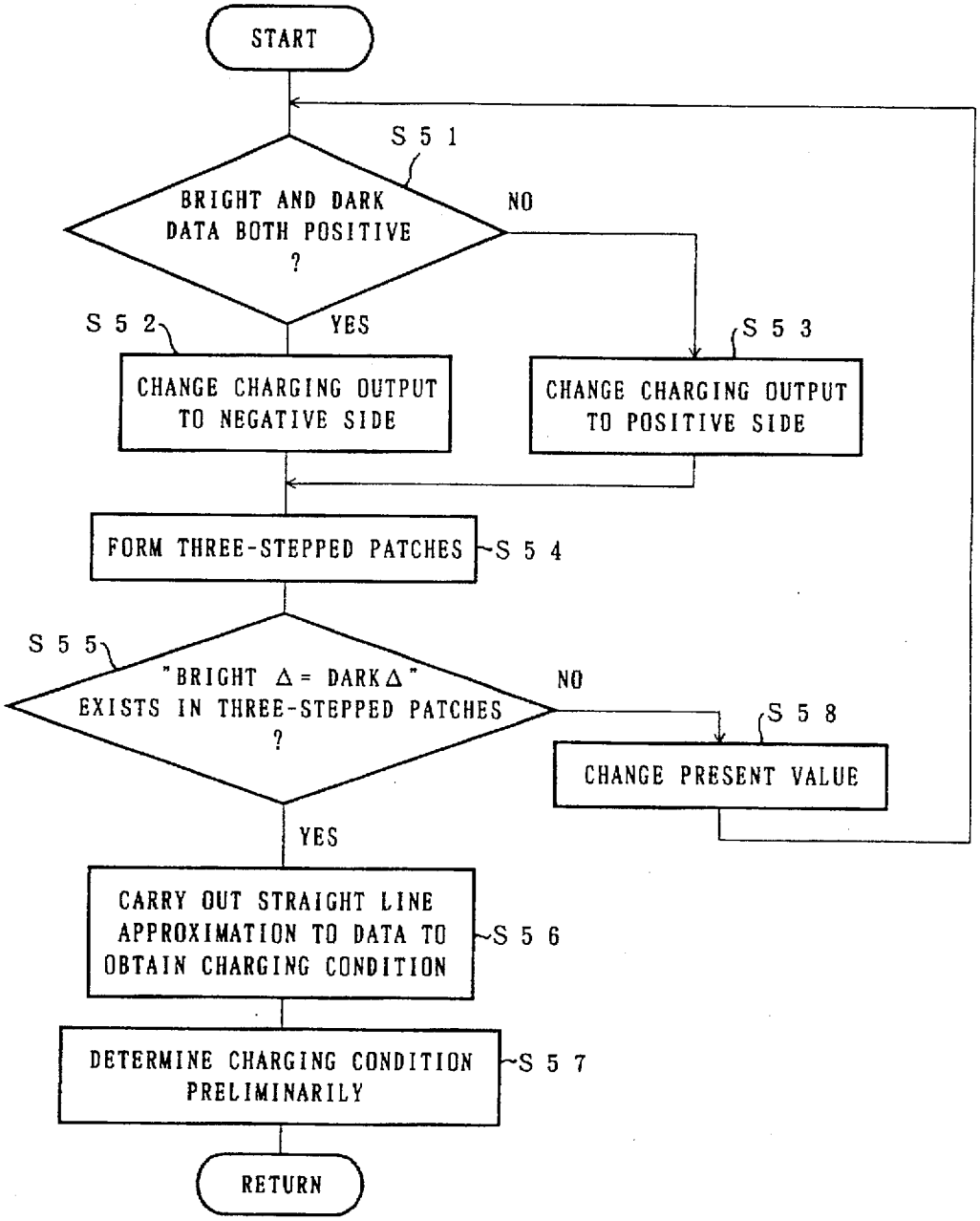
FIG. 13 is a flow chart showing a subroutine of preliminarily changing a charging condition in the control flow chart shown in FIG. 11.

Next, referring to FIG. 13, the subroutine of preliminarily changing the charging condition (S17 in FIG. 11) will be discussed.

First, the CPU 41 compares the present values of the charging potentials in the bright and dark parts (bright and dark data) of the electrostatic latent image detected in S11 in FIG. 11 and the respective initial values, in order to judge whether both the bright and dark data are greater than the initial values, that is, whether both the bright and dark data are positive (S51). If both the bright and dark data are positive, the CPU 41 determines to change the output of the charging device 20 (hereinafter, will be referred to as charging output) to the negative side (S52), and then proceeds to S54 (will be discussed later). If not both the bright and dark data are greater than the initial values in S51, the CPU 41 determines to change the charging output to the positive side (S53), and then proceeds to S54 (will be discussed later).

In S54, the charging output is shifted at ±30 V interval, to either the positive or negative side as determined in S52 or S53 to produce two charging outputs. The CPU 41 then forms three-stepped toner patches developed from electrostatic latent images in the bright and dark parts of the present value and of those two charging outputs. The two charging outputs, not including the present value, are voltage values of predetermined charging changes. The exposure condition here is the same as in the initial period. In other words, in S54, bright and dark toner patches corresponding to three charging outputs (i.e., the present value, ±30 V, and ±60 V) are formed on the photosensitive body 14.

Next, the CPU 41 detects densities of the toner patches formed as above with the detecting device **21*b*, and judges whether there exists in a density range expressed by the detected three-stepped toner patches a point at which the bright Δ equals the dark Δ (S55). If there exists in the above range a point at which the bright Δ equals the dark Δ, the CPU 41 carries out a straight line approximation to data corresponding to the three-stepped toner patches (S56). Then the CPU 41** preliminarily determines the charging condition and proceeds to S54 (S57).

On the other hand, if the point where the bright Δ equals the dark Δ does not exist in the density range expressed by the detected three-stepped toner patches in S55, the CPU 41 changes the present value and proceeds to S51 (S58). In this case, for example, if the initial value is on the positive side from the above density range, the CPU 41 changes the two-step-increased value to the present value, and then again carries out the subroutine of preliminarily changing the charging condition.

Figure 18:
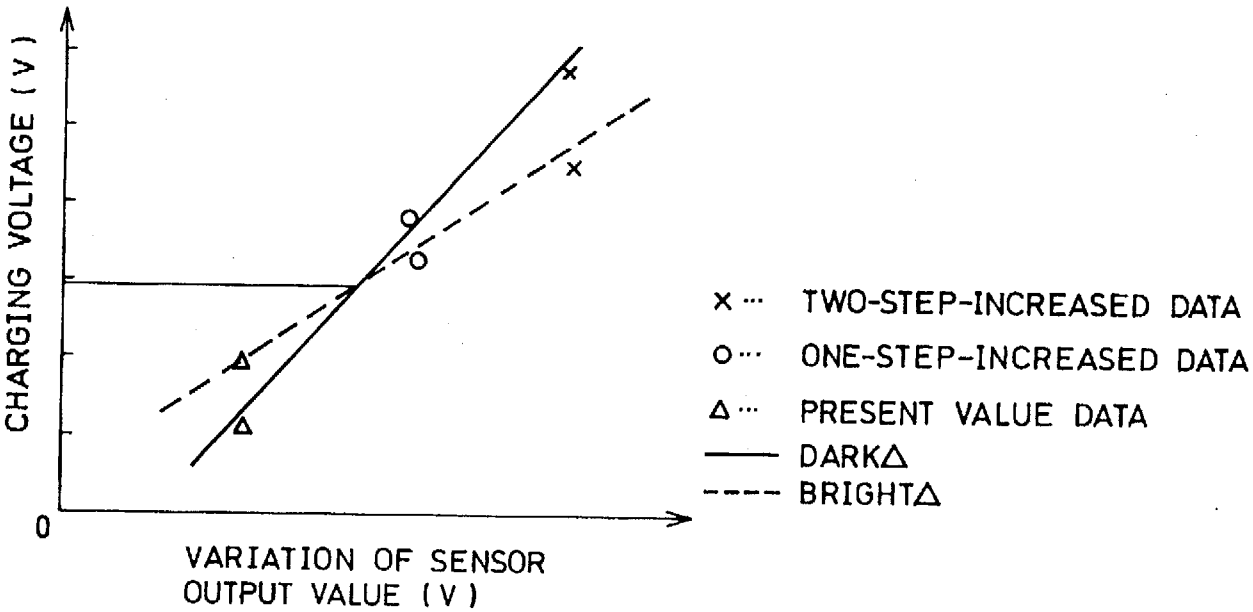
FIG. 18 is a graph showing correlation between a charging voltage and a sensor output value explaining approximation to a charging output.
Figure 19:
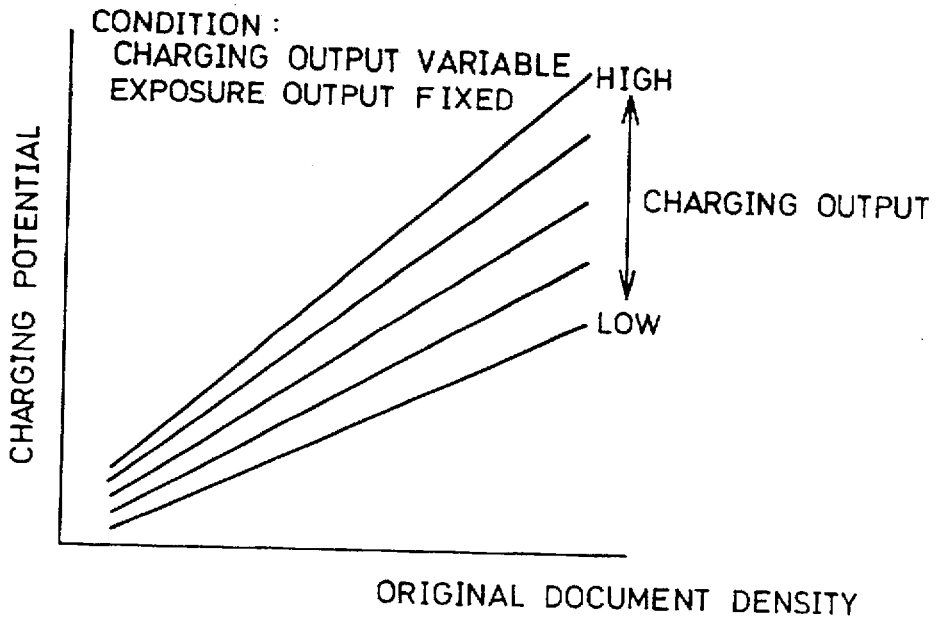
FIG. 19 is an explanatory drawing showing a charging characteristic of the photosensitive body when only the charging output is variable.
Figure 20:
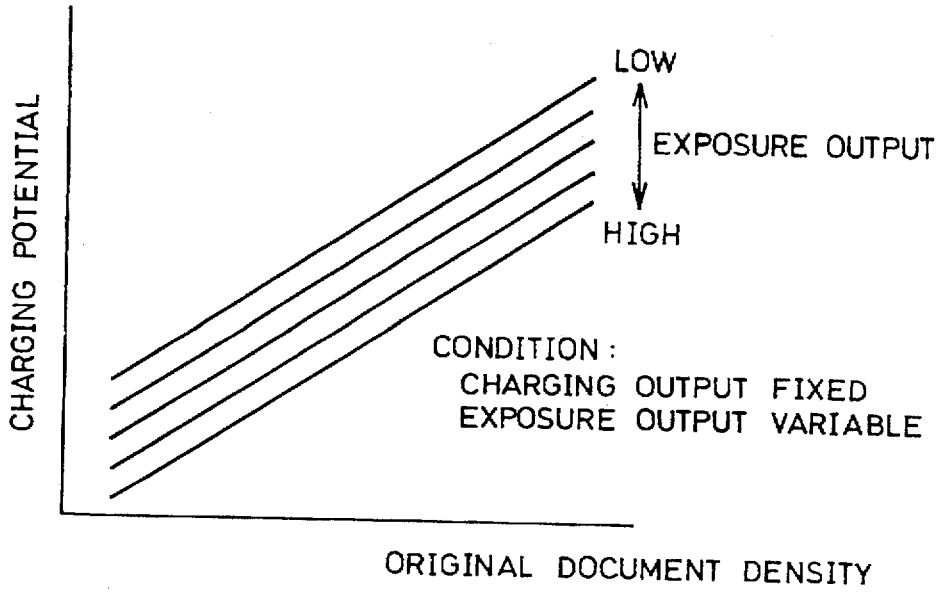
FIG. 20 is an explanatory drawing showing the charging characteristic of the photosensitive body when only the exposure output is variable.

Referring to FIG. 18, the following description will discuss the approximation to the charging output in S56.

Correlation graphs expressing correlation between the charging voltages (V) for forming the toner patches of the present value and of the other two steps on the surface of the photosensitive body 14, and the differences between reflective densities (sensor output values (V)) of the toner patches formed as above and the initial values (bright and dark Δs) are obtained. FIG. 18 shows such two correlation graphs respectively corresponding to the bright and dark Δs. A charging voltage corresponding to sensor output values where bright Δ=dark Δ is obtained from the correlation graphs.

Figure 14:
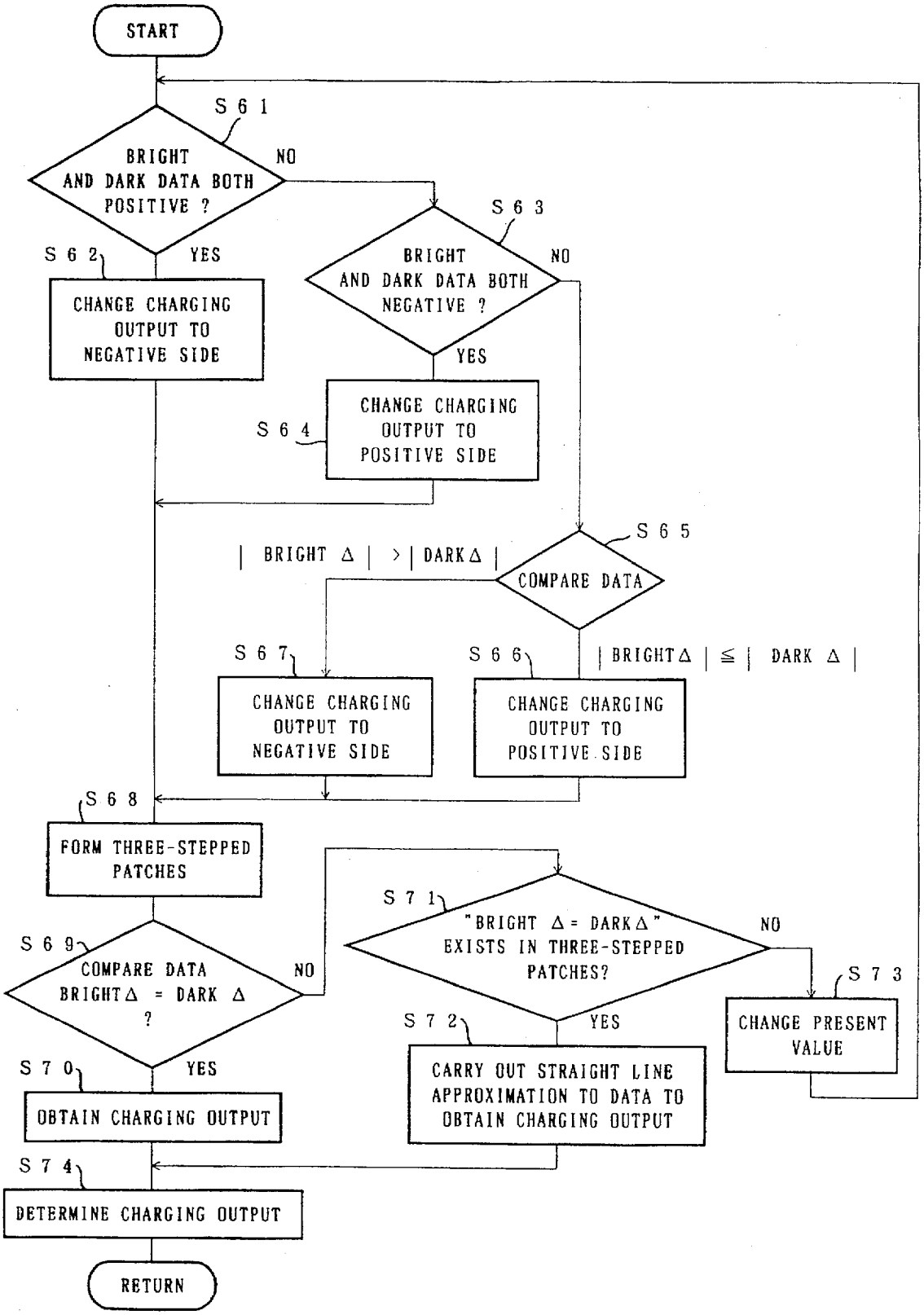
FIG. 14 is a flow chart showing a subroutine of changing (I) the charging condition in the control flow chart shown in FIG. 11.

Next, referring to FIG. 14, the subroutine of changing (I) the charging condition (S14 in FIG. 11) will be discussed.

First, if either the charging condition or the exposure condition is already preliminarily changed, the CPU 41 forms toner patches of bright and dark parts from values obtained as above in that preliminarily change operation. The CPU 41 then compares image densities in the bright and dark parts obtained (bright and dark data) and the respective initial values corresponding to these bright and dark data, in order to judge whether both the bright and dark data are greater than the initial values, that is, whether both the bright and dark data are positive (S61). If both the bright and dark data are positive, the CPU 41 determines to change the charging output to the negative side (S62), and then proceeds to S68 (will be discussed later).

If not both the bright and dark data are positive in S61, the CPU 41 judges whether both the bright and dark data are smaller than the initial values, that is, whether both the bright and dark data are negative (S63). If both the bright and dark data are negative, the CPU 41 determines to change the charging output to the positive side (S64), and then proceeds to S68 (will be discussed later).

If not both the bright and dark data are negative in S63, the CPU 41 compares the variations (bright Δ and dark Δ) between the bright and dark data and the initial values corresponding to these data (S65). If the absolute value of the bright Δ is smaller than or equal to the absolute value of the dark Δ, the CPU 41 determines to change the charging output to the positive side (S66), and then proceeds to S68 (will be discussed later). If the absolute value of the bright Δ is greater than the absolute value of the dark Δ, the CPU 41 determines to change the charging output to the negative side (S67), and then proceeds to S68 (will be discussed later).

In S68, the charging output is shifted by a step and two steps, ±30 V at a step, to either the positive or negative side as determined in S62, S64, S66, or S67 to produce two-stepped data. The CPU 41 then forms three-stepped toner patches developed from electrostatic latent images in the bright and dark parts of the present value and of the two-stepped data. The two-stepped charging outputs, not including the present value, are voltage values of predetermined charging changes. The exposure condition here is the same as in the initial period. In other words, in S68, bright and dark toner patches corresponding to three charging outputs (i.e., the present value, ±30 V, and ±60 V) are formed on the photosensitive body 14.

Next, the CPU 41 judges whether the bright Δ equals the dark Δ (S69). If the bright Δ equals the dark Δ, the CPU 41 obtains the charging output in accordance with the bright Δ and the dark Δ (S70), determines the charging condition, and proceeds to SIS in FIG. 11 (S74).

On the other hand, if it is judged that the bright Δ is not equal to the dark Δ in S69, the CPU 41 detects densities of the toner patches formed as above with the detecting device 21*b*, and judges whether there exists in a density range expressed by the detected three-stepped patches a point at which the bright Δ equals the dark Δ (S71). If there exists in the above range a point at which the bright Δ equals the dark Δ, the CPU 41 carries out a straight line approximation with data corresponding to the three-stepped patches, and thus obtains the charging output (S72), thereafter proceeding to S74. The same method is used in the approximation to the charging output as in S56 in FIG. 13.

On the other hand, if the point where the bright Δ equals the dark Δ does not exist in the density range expressed by the detected three-stepped patches in S71, the CPU 41 changes the present value (S73) and proceeds to S61. In this case, for example, if the initial value is on the positive side from the above density range, the CPU 41 again carries out, using the two-step-increased value as the present value, the subroutine of changing (I) the charging condition.

Figure 15:
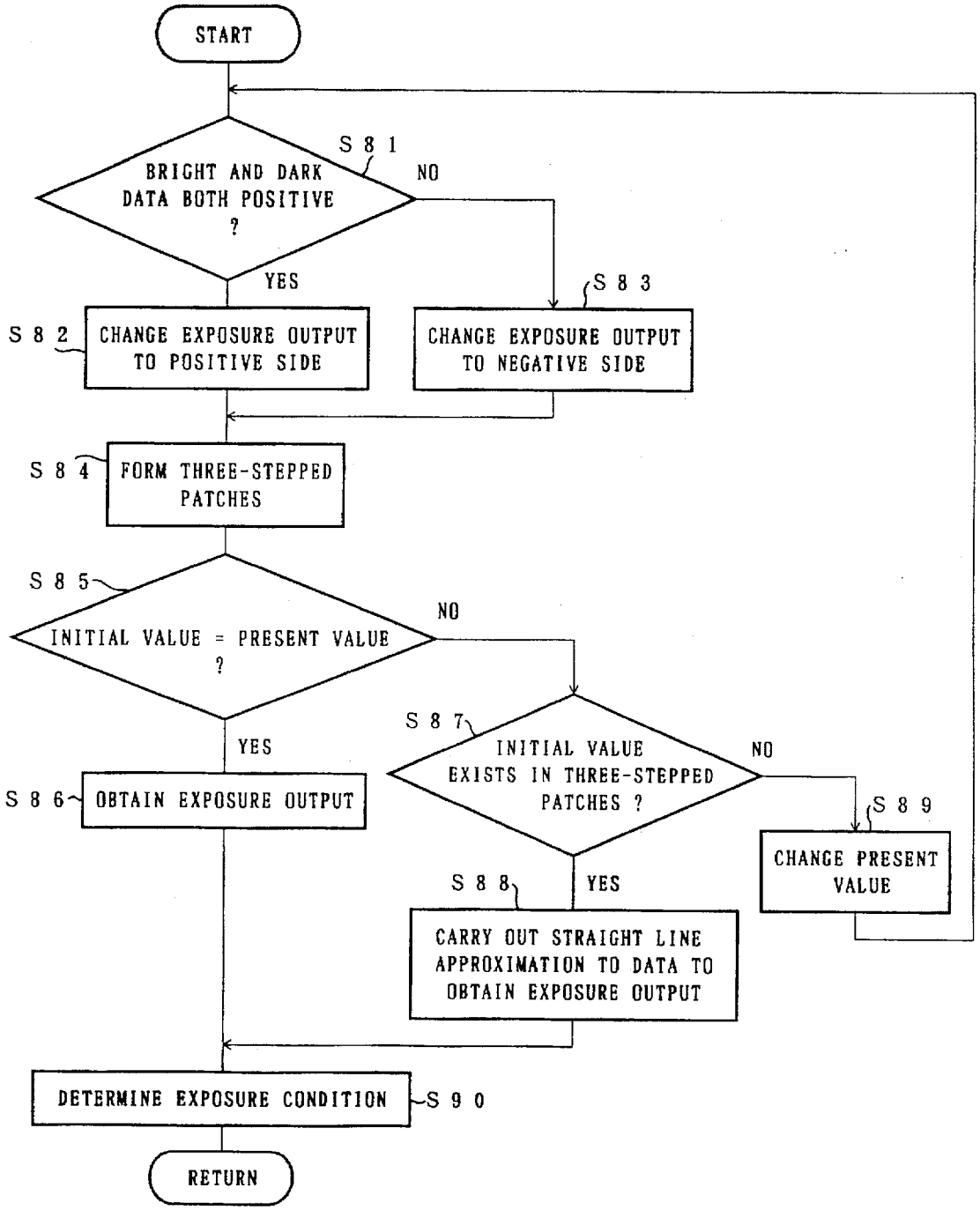
FIG. 15 is a flow chart showing a subroutine of changing an exposure condition in the control flow chart shown in FIG. 11.

Next, referring to FIG. 15, the subroutine of changing the exposure condition (S15 in FIG. 11) will be discussed.

First, if either the charging condition or the exposure condition is already preliminarily changed, or the charging condition is changed (I), the CPU 41 forms toner patches in bright and dark parts from values obtained in that operation. The CPU 41 then compares image densities in the bright and dark parts obtained (bright and dark data) and the respective initial values corresponding to these bright and dark data, in order to judge whether both the bright and dark data are greater than the initial values, that is, whether both the bright and dark data are positive (S81). If both the bright and dark data are positive, the CPU 41 determines to change the exposure output to the positive side (S82), and then proceeds to S84 (will be discussed later). If not both the bright and dark data are greater than the initial values, the CPU 41 determines to change the exposure output to the negative side (S83), and then proceeds to S84 (will be discussed later).

In S84, the exposure output is shifted by a step and two steps, ±1 V at a step, to either the positive or negative side as determined in S82 or S83 to produce two exposure outputs. The CPU 41 then forms three-stepped toner patches developed from electrostatic latent images in the bright and dark parts of the present value and of those two exposure outputs. The two-stepped exposure outputs, not including the present value, are voltage values of predetermined exposure changes. One step corresponds to, for example, a voltage for one step in manually changing the density of the copying machine. The charging condition here is the same as in the initial period. In other words, in S84, bright and dark toner patches corresponding to three exposure outputs (i.e., the present value, ±1 V, and ±2 V) are formed on the photosensitive body 14.

Next, the CPU 41 detects densities of the toner patches formed as above with the detecting device 21*b*, and judges whether the density corresponding to the present value among the detected three-stepped toner patches is equal to the density corresponding to the prerecorded initial value (S85). If the present value and the initial value are equal to each other, the CPU 41 obtains the exposure output corresponding to the image density at this time (S86). The CPU 41 then determines the exposure condition and proceeds to S20 shown in FIG. 1.

On the other hand, if the present value and the initial value are not equal in S85, the CPU 41 judges whether the initial value exists in a density range expressed by the detected three-stepped toner patches (S87). If the initial value exists in the above range, the CPU 41 carries out a straight line approximation with data corresponding to the three-stepped patches, and thus obtains the exposure output (S88), thereafter proceeding to S90. The approximation to the exposure output is carried out in the following manner.

Figure 25:
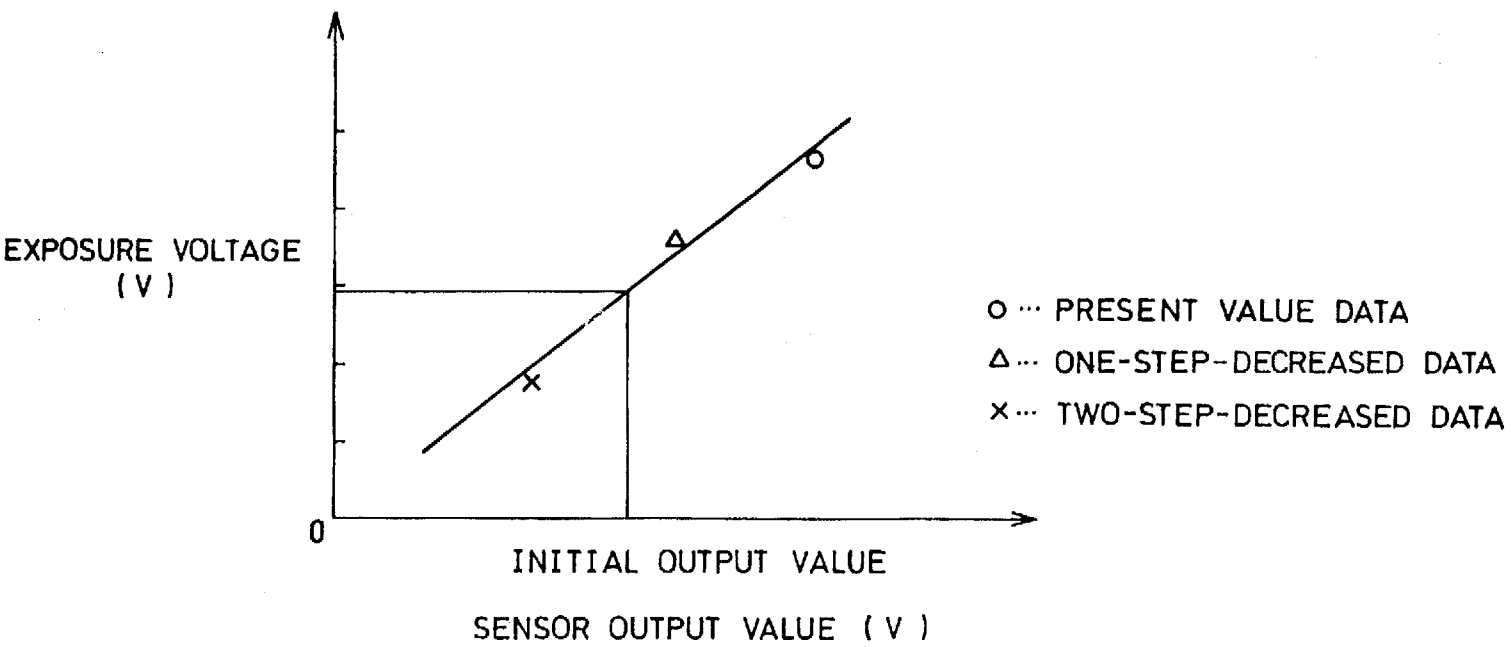
FIG. 25 is a graph showing correlation between an exposure voltage and a sensor output value explaining approximation to an exposure output.

A correlation graph is obtained from exposure voltage (V) for forming the patch of the present value and the other two-stepped patches on the surface of the photosensitive body 14 and from reflective densities (sensor output values (V)) of the toner patches formed as above. The graph in FIG. 25 shows the correlation between the exposure voltage (V) and the sensor output values (V). Here, the present value and the data obtained by decreasing the exposure output by one step and two steps from the present value are used. An exposure voltage corresponding to the initial value (output value of the detecting device 21*b* for detecting the reflective density of the initial toner patch) is obtained from the correlation graph.

On the other hand, if the initial value does not exist in the density range expressed by the detected three-stepped toner patches in S87, the CPU 41 changes the present value (S89) and proceeds to S81. In this case, for example, if the initial value is on the positive side from the above density range, the CPU 41 again carries out, using the two-step-increased value as the present value, the subroutine of changing the exposure condition.

Figure 16:
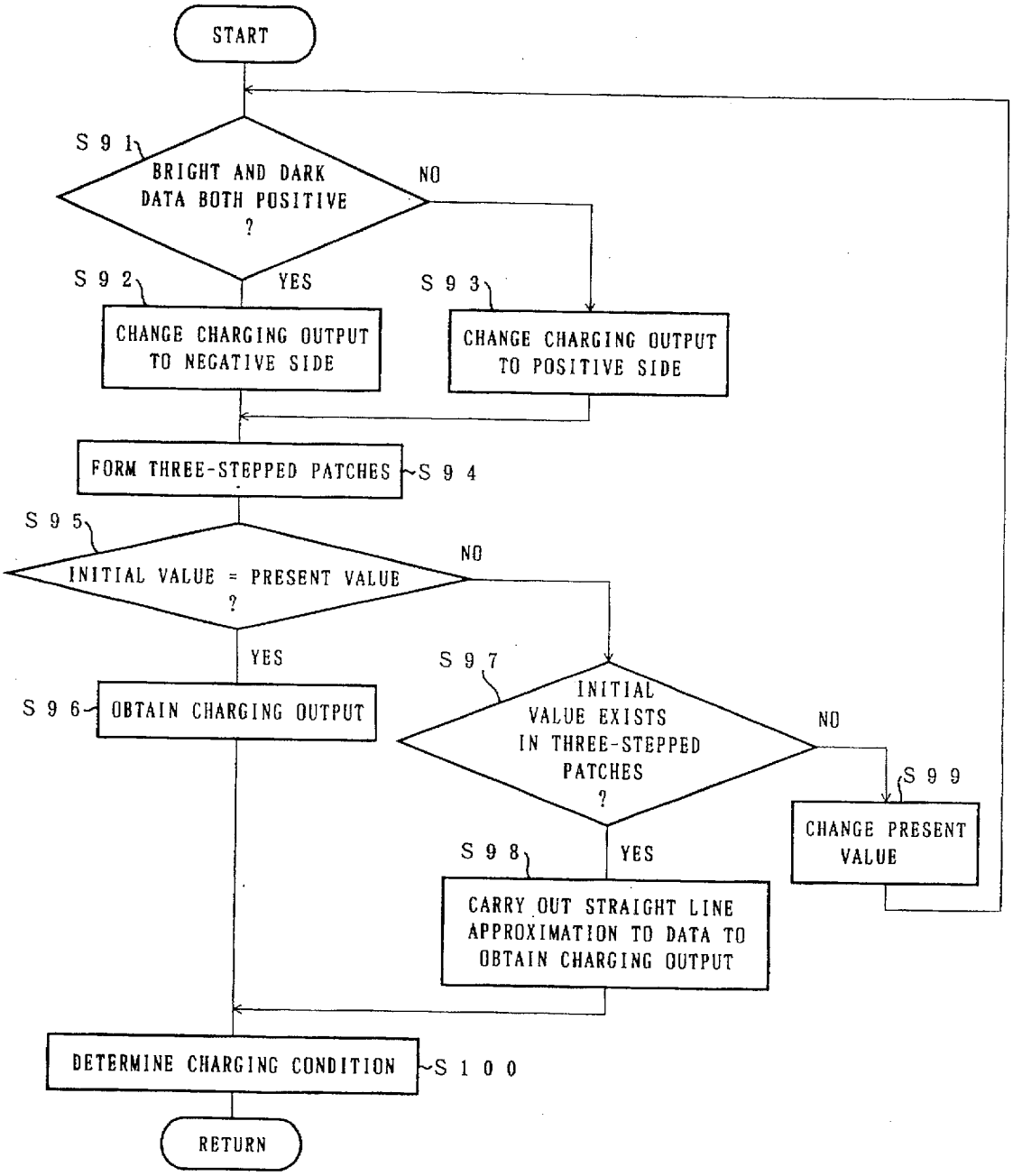
FIG. 16 is a flow chart showing a subroutine of changing (II) the charging condition in the control flow chart shown in FIG. 11.

Next, referring to FIG. 16, the subroutine of changing (II) the charging condition (S19 in FIG. 11) will be discussed.

First, the CPU 41 compares the present values of the charging potentials in the bright and dark parts (bright and dark data) of the electrostatic latent image detected in S11 in FIG. 11 and the respective initial values, in order to judge whether both the bright and dark data are greater than the initial values, that is, whether both the bright and dark data are positive (S91). If both the bright and dark data are positive, the CPU 41 determines to change the charging output to the negative side (S92), and then proceeds to S94 (will be discussed later). If not both the bright and dark data are greater than the initial values in S91, the CPU 41 determines to change the charging output to the positive side (S93), and then proceeds to S94 (will be discussed later).

In S94, the charging output is shifted at ±30 V interval, to either the positive or negative side as determined in S92 or S93 to produce two-stepped data. The CPU 41 then forms toner patches developed from electrostatic latent images in the bright and dark parts of the present value and of those two-stepped data (toner patches of three different steps in total). The two-stepped charging outputs, not including the present value, are voltage values of predetermined charging changes. The exposure condition here is the same as in the initial period. In other words, in S68, bright and dark toner patches corresponding to three charging outputs (i.e., the present value, ±30 V, and ±60 V) are formed on the photosensitive body Next, the CPU 41 detects densities of the toner patches formed as above with the detecting device 21*b*, and judges whether the density value corresponding to the present value among the detected three-stepped toner patches is equal to the density value corresponding to the prerecorded initial value (S95). If the present value and the initial value are equal to each other, the CPU 41 determines the exposure output in accordance with these image densities (S96). The CPU 41 then determines the exposure condition (S100) and proceeds to S20 shown in FIG. 11.

On the other hand, if the present value and the initial value are not equal to each other in S95, the CPU 41 judges whether the initial value exists in a density range expressed by the detected three-stepped toner patches (S97). If the initial value exists in the above range, the CPU 41 carries out a straight line approximation with data corresponding to the three-stepped toner patches, and thus obtains the charging output (S98), thereafter proceeding to S100. The approximation to the charging output is carried out in the following manner.

Figure 26:
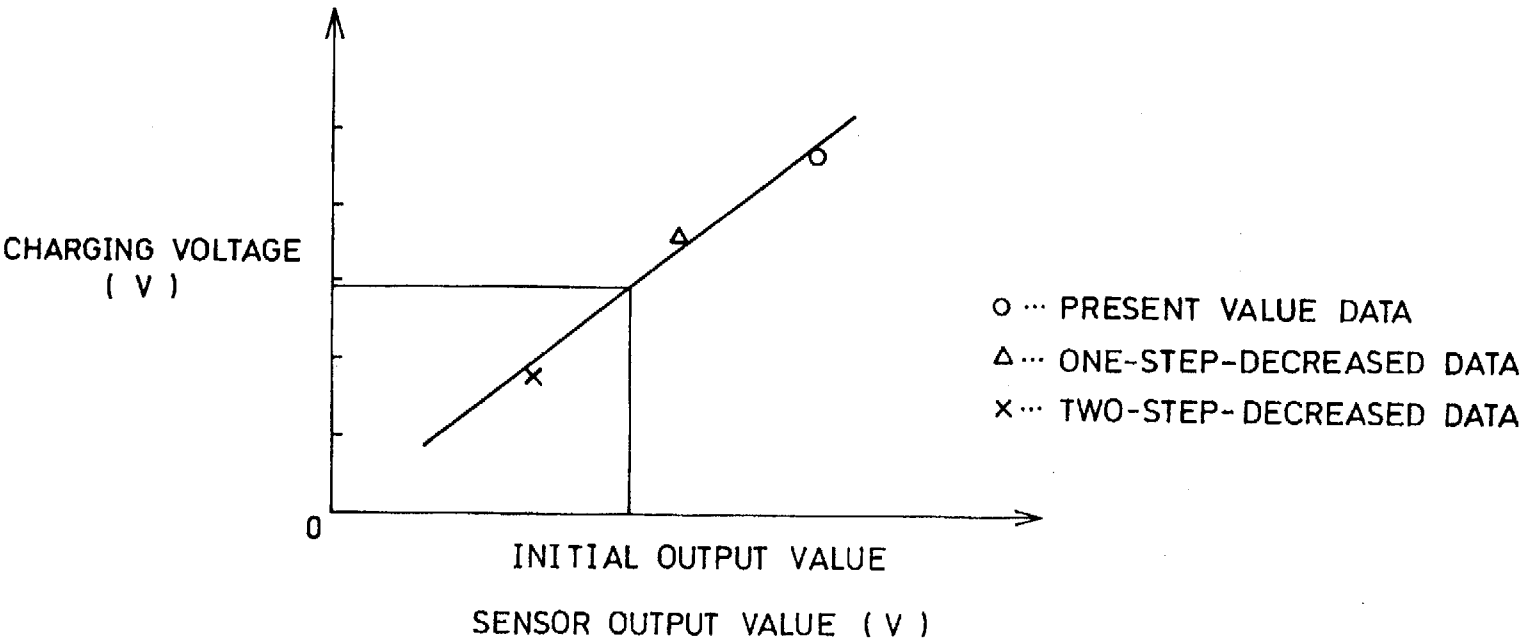
FIG. 26 is a graph showing correlation between a charging voltage and the sensor output value explaining approximation to a charging output.

A correlation graph is obtained from reflective densities (sensor output values (V)) of the toner patches formed in accordance with charging voltage (V) for forming the patch of the present value and the other two-stepped patches on the surface of the photosensitive body 14. The graph in FIG. 26 shows the correlation between the charging voltage (V) and the sensor output values (V). Here, the present value and the data obtained by decreasing the charging output by one step and two steps from the present value are used. A charging voltage corresponding to the initial value (output value of the detecting device 21*b* for detecting the reflective density of the initial toner patch) is obtained from the correlation graph.

On the other hand, if the initial value does not exist in the density range expressed by the detected three-stepped patches in S97, the CPU 41 changes the present value (S99) and proceeds to S91. In this case, for example, if the initial value is on the positive side from the above density range, the CPU 41 again carries out, using the two-step-increased value as the present value, the subroutine of changing (II) the charging condition.

As discussed so far, when the aged values are to be corrected, according to the image stabilizer configured in the above manner, the initial characteristics and the aged characteristics of the photosensitive body can be made virtually identical by the control of, first, changing the charging output (output of the charging device 20) as the second parameter relevant to the control of the charging quantity so that the differences between the initial values of the surface potential of the photosensitive body 14 or the image density and the aged values are almost equal, and then changing the exposure output (light source output of the copy lamp 6) as the first parameter relevant to the control of the exposure quantity so that at least one of the aged values of the surface potential or the image density can be almost equal to the corresponding initial value.

Therefore, the image stabilizer capable of producing extremely stable images can be realized by controlling, using the initial and aged values of the signals corresponding to the charged images in the bright part 14*b* and the dark part 14*a* formed on the photosensitive body 14 as appropriate signals corresponding to the charging characteristic and the image characteristic of the above mentioned photosensitive body 14, the charging condition and the exposure condition of the photosensitive body by changing the processing method of those signals.

Moreover, when the aged values are to be corrected, the initial characteristics and the aged characteristics of the photosensitive body can be made virtually identical by controlling a slope value of the initial values and of the corresponding aged values of the charging output so that the slope value is almost equal.

In this case, the CPU 41 includes: first means (a first section) for measuring the initial value relevant to the second parameter at a plurality of points in the electrostatic latent image formed on the photosensitive body 14, obtaining from these initial values a first slope value representing a ratio of the γ characteristics to an original document density change, and recording the first slope value; second means (a second section) for, after an image process is carried out a predetermined number of times, measuring an aged value which has deviated from the initial value of the second parameter at a plurality of points in the electrostatic latent image, obtaining from these aged values a second slope value representing a ratio of a γ characteristics change to the original document density change, and recording the second slope value; and correcting means (a correcting section) for comparing the first and second slope values recorded in the first and second means, and performing a second parameter control and a first parameter control, the second parameter control changing the second parameter in accordance with a result of the comparison so that the second slope value is almost equal to the first slope value, the first parameter control changing the first parameter so that at least one of the aged values relevant to the corrected second parameter is almost equal to the initial value corresponding to that aged value.

Incidentally, the charging characteristics of the photosensitive body 14 to exposure differs in the high potential area side and in the low potential area side as illustrated in FIG. 7. Therefore, in a case where the difference between the initial and aged values in the dark part is smaller than the difference in the bright part, the charging output relevant to the control of the charging amount can be changed in a potential area in which the charging characteristics of the photosensitive body are the same by preliminarily changing the exposure output so that the difference between the initial and aged values in the dark part of the surface potential or of the image density is greater than the difference in the bright part.

Therefore, in the case where the difference between the initial and aged values in the dark part is smaller than the difference in the bright part, if, first, the exposure output is preliminarily changed, then the charging output is changed, and finally the exposure output is changed again so that the difference between the initial and aged values in the dark part becomes greater than the difference in the bright part, the displacement of the aged characteristics controlled with respect to the initial characteristics will be eliminated, and the initial characteristics and the aged characteristics can be thus made virtually identical.

Moreover, in a case where the difference between the initial and aged values in the bright part is smaller than the difference in the dark part, and the difference in the bright part is smaller than the predetermined value, the initial and aged characteristics of the photosensitive body can be made almost the same to human eyes by changing the charging output so that the difference or the slope value between the initial and corresponding aged values of the surface potential or the image density are virtually identical. This eliminates the need for the control of changing the exposure output after the charging output is changed, thus facilitating the control of the image stabilization and cutting down the time required for correcting the aged characteristics.

Moreover, in the present embodiment, the charging and image characteristics of the photosensitive body 14 are directly detected using the surface potential meter as the detecting device 21*a* for detecting the surface potential of the photosensitive body 14, or the photo interrupter, which is a reflective sensor, as the detecting device 21*b* for detecting the image density of the photosensitive body 14, in order to directly detecting the charging and image characteristics of the photosensitive body 14.

In this case, since the surface potential or the image density, which are generally well-known parameters, can be directly detected, the charging and image characteristics of the photosensitive body can be detected precisely. Especially, in a case of detecting the image characteristics of the photosensitive body 14 by detecting the image density, since the photo interrupter (density sensor) which is relatively cheap compared with the surface potential meter can be used, it is possible to offer a relatively cheap image stabilizer.

As discussed above, although the charging characteristics and the image characteristics are configured to be directly detected, there are alternatives to this. For example, the charging characteristics and the image characteristics may be configured to be indirectly detected.

Examples of methods of indirectly detecting the charging characteristics and the image characteristics as discussed above include measurement of a developing current which occurs upon visualization of the electrostatic latent image formed on the surface of the photosensitive body 14 with developer and which flows between the developing device 15 and the photosensitive body 14. In this case, an ampere meter for detecting the developing current of a development bias voltage electrode (not shown) applied to the developing device 15 is used. This developing current flowing between the developing device 15 and the photosensitive body 14 has a proportional value to a toner quantity moving along an electric field from a surface of a developing roller 15*a* to the surface of the photosensitive body 14, that is, a proportional value to the image density.

According to this, since the charging characteristics and the image characteristics of the photosensitive body 14 are indirectly detected, although such a detection is a little inferior to the direct detection in terms of precision, since the detecting device for detecting each state has a simple configuration, development of a device and time for development can be reduced, and since the configuration is simple, manufacturing cost of the image stabilizer can be reduced, and as a result, it is possible to offer a cheap image stabilizer.

Moreover, another example of methods of indirectly detecting the charging characteristics and the image characteristics of the photosensitive body 14 is measurement of a charging current on the surface of the photosensitive body 14. In this case, the detecting device detects the charging current of the photosensitive body 14 by bringing, for example, a discharging brush disposed at the same place as the detecting device 21*a* in contact with the surface of the photosensitive body 14 in the charging state. A charging current on the front surface of the photosensitive body 14 has a proportional value to the charging potential of the photosensitive body 14.

According to this, the functions and effects in the case where the developing current is used can be obtained. Besides, since the charging current has a bigger value than a plain cylinder current flowing through a plain cylinder (will be discussed in the following) of the photosensitive body 14, precision in control can be improved.

Moreover, a further example of methods of indirectly detecting the charging characteristics and the image characteristics of the photosensitive body 14 is measurement of the plain cylinder current flowing through the plain cylinder (not shown) of the photosensitive body 14. In this case, the detecting device detects the plain cylinder current of the photosensitive body 14 with an ampere meter for detecting the current of the plain cylinder (bare surface aluminum electrode) of the photosensitive body 14 (not shown). The plain cylinder current of the photosensitive body 14 has a proportional value to the charging potential of the photosensitive body 14 which is cancelled upon the exposure of the photosensitive body 14.

According to this, the functions and effects in the case where the developing current and the charging current is used can be obtained. Besides, since the plain cylinder current flowing through the plain cylinder of the photosensitive body 14 is greater than the developing current flowing between the developing device 15 and the photosensitive body 14, the control can be carried out with better precision than in a case where the charging current is used.

Moreover, the charging characteristics or the image characteristics may change due to excessive toner adhering to the surface of the photosensitive body 14. In addition, in a case where, for example, a current is measured for a long time, toner visualized by the developing device may be wasted.

Such adhesion of the excessive toner, especially, to the photosensitive body can be eliminated by stopping toner supply to the photosensitive body with toner supply halting means when the charging current and the plain cylinder current are measured. As a result, the charging characteristics and the image characteristics of the photosensitive body are not affected, and the image stabilizing control can be therefore carried out with good precision.

Moreover, an example of the toner supply halting means is that the blank lamp is turned on and that the discharging devices, except the charging device, (i.e., the transfer device, a peeling device, etc.) are stopped. Another example is that the developing device is turned into non-development mode and that the discharging devices, except the charging device, are stopped.

Another example of such means is that a toner exhaust port of the developing device is provided with a shutter which is closed to prevent the toner from leaking to the photosensitive body side from the developing device while the image stabilizing process is being carried out.

In the present embodiment is discussed a copying machine which is an image stabilizer of a so-called positive-to-positive type which sticks the toner to the bright part of the electrostatic latent image on the photosensitive body, and then transfers the toner image onto the paper to form an image. Nevertheless, this is not the only possibility. The only condition is that an electrostatic latent image is formed on the surface of the photosensitive body. An example satisfying such a condition is an image stabilizer of a so-called negative-to-positive type which sticks the toner to the dark part of the electrostatic latent image on the photosensitive body, and then transfers the toner image onto the paper to form an image.

The invention being thus described, it will be obvious that the same may be varied in many ways. Such variations are not to be regarded as a departure from the spirit and scope of the invention, and all such modifications as would be obvious to one skilled in the art intended to be include within the scope of the following claims.

What is claimed is:

1. An image stabilizer, incorporated in an image forming apparatus which visualizes with a developing agent an electrostatic latent image obtained by exposing original document to light and guiding light reflected at the original document to a charged photosensitive body surface, for stabilizing a formed image by changing a first parameter relevant to control of exposure quantity and a second parameter relevant to control of charging quantity among a plurality of control parameters determining γ characteristics of the image forming apparatus, comprising:

first means for measuring an initial value relevant to the second parameter at at least two points in the electrostatic latent image, obtaining from these initial values a first slope value representing a ratio of the γ characteristics change to an original document density change, and recording the first slope value;

second means for, after an image process is carried out a predetermined number of times, measuring an aged value which has deviated from the initial value of the second parameter at at least two points in the electrostatic latent image, obtaining from these aged values a second slope value representing a ratio of a γ characteristics change to the original document density change, and recording the second slope value; and correcting means for comparing the first and second slope values recorded in said first and second means, and performing a second parameter control and a first parameter control, the second parameter control changing the second parameter in accordance with a result of the comparison so that the second slope value is almost equal to the first slope value, the first parameter control changing the first parameter so that at least one of the aged values relevant to the corrected second parameter is almost equal to the initial value corresponding to that aged value.

2. The image stabilizer as defined in claim 1, wherein the initial value is measured at at least one point corresponding to a bright part of the electrostatic latent image and at least one point corresponding to a dark part of the electrostatic latent image, and the aged value is measured correspondingly to the bright part and the dark part with the same original document density as the measured initial value.

3. The image stabilizer as defined in claim 2, wherein before performing the second parameter control, said correcting means (1) compares a first difference and a second difference with respect to the second parameter, the first difference being a difference between the initial and aged values corresponding to the bright part, the second difference being a difference between the initial and aged values corresponding to the dark part, then (2) when the comparison shows that the second difference is smaller than the first difference, changes the first parameter so that the second difference becomes greater than the first difference, and finally, (3) performs the first and second parameter controls.

4. The image stabilizer as defined in claim 2, wherein said correcting means (1) compares a first difference and a second difference with respect to the second parameter, the first difference being a difference between the initial and aged values corresponding to the bright part, the second difference being a difference between the initial and aged values corresponding to the dark part, then (2) when the comparison shows that the first difference is smaller than the second difference and that the first difference is smaller than a predetermined value, performs with respect to the second parameter the second parameter control of changing the second parameter so that the first and second differences become almost equal to each other in accordance with a result of the comparison, and finally, (3) performs the first parameter control.

5. The image stabilizer as defined in claim 1, further comprising:

a light source for exposing the original document to light; and a standard plate including a bright standard plate and a dark standard plate which are sequentially exposed to light from said light source when the initial and aged values are judged, wherein the electrostatic latent image is formed in accordance with said standard plate.

6. The image stabilizer as defined in claim 1, wherein the initial and aged values are surface potential values of the photosensitive body, and the second parameter is a charging output to the photosensitive body.

7. The image stabilizer as defined in claim 1, wherein the initial and aged values are toner image densities visualized with the developing agent from the electrostatic latent image formed on the photosensitive body surface, and the second parameter is a charging output to the photosensitive body.

8. The image stabilizer as defined in claim 1, wherein the initial and aged values are developing currents which occur when the electrostatic latent image formed on the photosensitive body surface is visualized with the developing agent and which flow between a developing device and the photosensitive body, and the second parameter is a charging output to the photosensitive body.

9. The image stabilizer as defined in claim 1, wherein the initial and aged values are charging currents on the photosensitive body surface, and the second parameter is a charging output to the photosensitive body.

10. The image stabilizer as defined in claim 9, further comprising control means for stopping toner supply to the photosensitive body when the charging current of the photosensitive body is measured.

11. The image stabilizer as defined in claim 1, wherein the photosensitive body includes a plain cylinder, wherein the initial and aged values are plain cylinder currents flowing through the plain cylinder of the photosensitive body, and the second parameter is a charging output to the photosensitive body.

12. The image stabilizer as defined in claim 11, further comprising control means for stopping toner supply to the photosensitive body when the plain cylinder current of the photosensitive body is measured.

13. The image stabilizer as defined in claim 1, wherein said correcting means performs the first and second parameter controls when a temperature of a fixing section for fixing the toner image is below a predetermined value.

14. The image stabilizer as defined in claim 1, wherein said image stabilizer judges whether a predetermined period of time has elapsed since the last operation by said correcting means, and, when the predetermined period is exceeded, said correcting means performs the first and second parameter controls.

15. The image stabilizer as defined in claim 1, wherein said correcting means performs the first and second parameter controls when the number of copied sheets exceeds a predetermined number.

16. An image stabilizer, incorporated in an image forming apparatus which visualizes with a developing agent from a developing device an electrostatic latent image obtained by exposing original document to light and guiding light reflected at the original document to a charged photosensitive body surface, for stabilizing a formed image by changing a first parameter relevant to control of exposure quantity and a second parameter relevant to control of charging quantity among a plurality of control parameters determining γ characteristics of the image forming apparatus, comprising:

first means for measuring at least one initial value relevant to the second parameter corresponding to a bright part of the electrostatic latent image and at least one initial value relevant to the second parameter corresponding to a dark part of the electrostatic latent image, and recording those initial values;

second means for, after an image process is carried out a predetermined number of times, measuring aged values which have deviated from the initial values of the second parameter, and recording those aged values; and correcting means for comparing the initial and aged values recorded in said first and second means, and performing a second parameter control and a first parameter control, the second parameter control changing the second parameter in accordance with a result of the comparison so that a first difference between the initial and aged values corresponding to the bright part is almost equal to a second difference between the initial and aged values corresponding to the dark part with respect to the second parameter, the first parameter control changing the first parameter so that at least one of the aged values relevant to the corrected second parameter is almost equal to the initial value corresponding to that aged value.

17. The image stabilizer as defined in claim 16, further comprising:

a light source for exposing the original document to light; and a standard plate including a bright standard plate and a dark standard plate which are sequentially exposed to light from said light source when the initial and aged values are judged, wherein the electrostatic latent image is formed in accordance with said standard plate.

18. The image stabilizer as defined in claim 16, wherein before performing the second parameter control, said correcting means (1) compares the first difference corresponding to the bright part and the second difference corresponding to the dark part with respect to the second parameter, then (2) when the comparison shows that the second difference is smaller than the first difference, changes the first parameter so that the second difference becomes greater than the first difference, and finally, (3) performs the first and second parameter controls.

19. The image stabilizer as defined in claim 16, wherein said correcting means (1) compares the first difference corresponding to the bright part and the second difference corresponding to the dark part with respect to the second parameter, then (2) when the comparison shows that the first difference is smaller than the second difference and that the first difference is smaller than a predetermined value, performs the second parameter control of changing the second parameter in accordance with a result of the comparison so that the first and second differences become almost equal to each other with respect to the second parameter, and finally, (3) performs the first parameter control.

20. The image stabilizer as defined in claim 16, wherein the initial and aged values are surface potential values of the photosensitive body, and the second parameter is a charging output to the photosensitive body.

21. The image stabilizer as defined in claim 16, wherein the initial and aged values are toner image densities visualized with the developing agent from the electrostatic latent image formed on the photosensitive body surface, and the second parameter is a charging output to the photosensitive body.

22. The image stabilizer as defined in claim 16, wherein the initial and aged values are developing currents which occur when the electrostatic latent image formed on the photosensitive body surface is visualized with the developing agent and which flow between the developing device and the photosensitive body, and the second parameter is a charging output to the photosensitive body.

23. The image stabilizer as defined in claim 16, wherein the initial and aged values are charging currents on the photosensitive body surface, and the second parameter is a charging output to the photosensitive body.

24. The image stabilizer as defined in claim 23, further comprising control means for stopping toner supply to the photosensitive body when the charging current of the photosensitive body is measured.

25. The image stabilizer as defined in claim 16, wherein the photosensitive body includes a plain cylinder, wherein the initial and aged values are plain cylinder currents flowing through the plain cylinder of the photosensitive body, and the second parameter is a charging output to the photosensitive body.

26. The image stabilizer as defined in claim 25, further comprising control means for stopping toner supply to the photosensitive body when the plain cylinder current of the photosensitive body is measured.

27. The image stabilizer as defined in claim 16, wherein said correcting means performs the first and second parameter controls when a temperature of a fixing section for fixing the toner image is below a predetermined value.

28. The image stabilizer as defined in claim 16, wherein said image stabilizer judges whether a predetermined period of time has elapsed since the last operation by said correcting means, and, when the predetermined period is exceeded, said correcting means performs the first and second parameter controls.

29. The image stabilizer as defined in claim 16, wherein said correcting means performs the first and second parameter controls when the number of copied sheets exceeds a predetermined number.

* * * * *